US010403080B2

(12) United States Patent
Morgan et al.

(10) Patent No.: US 10,403,080 B2
(45) Date of Patent: Sep. 3, 2019

(54) STORAGE SYSTEM FOR SUPPLYING ARTICLES

(71) Applicant: SUPPLY POINT SYSTEMS LIMITED, Leicestershire (GB)

(72) Inventors: Jeffery Morgan, Coventry (GB); Christopher Iain Clark, Leicestershire (GB); Christopher Marriott, Leicester (GB); Michael Guppy, Northampton (GB)

(73) Assignee: Supply Point Systems Limited, Leicestershire (GB)

( * ) Notice: Subject to any disclaimer, the term of this patent is extended or adjusted under 35 U.S.C. 154(b) by 96 days.

(21) Appl. No.: 15/283,535

(22) Filed: Oct. 3, 2016

(65) Prior Publication Data

US 2017/0092035 A1 Mar. 30, 2017

Related U.S. Application Data

(62) Division of application No. 13/635,780, filed as application No. PCT/GB2011/000383 on Mar. 18, 2011, now Pat. No. 9,492,012.

(30) Foreign Application Priority Data

Mar. 19, 2010 (GB) ..... 1004668.8

(51) Int. Cl.
*G07F 11/62* (2006.01)
*A47B 88/994* (2017.01)
(Continued)

(52) U.S. Cl.
CPC ..... *G07F 11/62* (2013.01); *A47B 88/40* (2017.01); *A47B 88/453* (2017.01);
(Continued)

(58) Field of Classification Search
CPC ..... G07F 11/46; G07F 11/62; G07F 17/0092; G07F 11/60; G07F 11/002; G07F 11/18;
(Continued)

(56) References Cited

U.S. PATENT DOCUMENTS 1,446,036 A * 2/1923 Dodd ..... A47F 5/08 211/85.17
3,355,231 A 11/1967 Kegel
(Continued)

FOREIGN PATENT DOCUMENTS

JP 1-108138 U 7/1989
WO WO 97/46779 12/1997
(Continued)

OTHER PUBLICATIONS

Application and File History for U.S. Appl. No. 13/635,780, filed Nov. 30, 2012, Inventors: Morgan et al.
(Continued)

*Primary Examiner* — Hiwot E Tefera
(74) *Attorney, Agent, or Firm* — Patterson Thuente Pedersen, P.A.

(57) ABSTRACT

A storage system comprising: a cartridge, said cartridge including an upright having mounted to one side a plurality of guide blocks; a plurality of first drawer information means for providing information on at least one of position and movement of respective drawers; and a plurality of latch mechanisms, said system further comprising a plurality of drawers, each said drawer including: guide block engaging means extending in a depth direction of the drawer and mounting a first side of the drawer adjacent a respective guide block; second drawer information means disposed adjacent the first drawer information means; and at least one stop on the first side of the drawer for engaging with a said latch mechanism, wherein the latch mechanisms are elec-
(Continued)

tronically controllable, whereby access to the drawers can be controlled.

15 Claims, 20 Drawing Sheets

(51) Int. Cl.

| | |
|---|---|
| ***A47B 88/453*** | (2017.01) |
| ***G07F 17/00*** | (2006.01) |
| ***A47B 96/00*** | (2006.01) |
| ***A47B 88/40*** | (2017.01) |
| ***A47B 88/90*** | (2017.01) |
| ***A47B 88/497*** | (2017.01) |
| ***A47B 88/969*** | (2017.01) |
| *A47G 29/14* | (2006.01) |

(52) U.S. Cl.
CPC ..... *A47B 88/497* (2017.01); *A47B 88/90* (2017.01); *A47B 88/969* (2017.01); *A47B 88/994* (2017.01); *A47B 96/00* (2013.01); *G07F 17/0092* (2013.01); *A47G 2029/146* (2013.01)

(58) Field of Classification Search
CPC .... G06F 19/3462; E05B 65/462; E05B 65/46; A47B 88/04; A47B 88/20; A47B 96/00; A47B 67/02; A47B 88/994; A47B 88/453; A47B 88/969; A47B 88/497; A47B 88/90; A61J 7/0084; A61J 7/0069; A47G 2029/146
USPC ..... 312/216, 330.1, 221, 319.5; 700/236, 700/242, 244; 221/2, 7, 154, 131
See application file for complete search history.

(56) References Cited

U.S. PATENT DOCUMENTS 3,581,906 A * 6/1971 Joyce ..... A47B 87/02 206/509
3,734,526 A * 5/1973 Propst ..... B62B 3/16 213/221
3,999,818 A * 12/1976 Schankler ..... A47B 87/02 312/107
4,243,279 A * 1/1981 Ackeret ..... B65D 21/0201 108/64
4,377,241 A * 3/1983 Schreiner ..... A47F 5/0025 108/55.1
4,605,988 A * 8/1986 Nienhuis ..... H05F 3/02 174/51
4,616,890 A 10/1986 Romick
5,158,347 A * 10/1992 Warren ..... E05B 17/0029 312/319.8
5,225,825 A 7/1993 Warren
5,881,892 A * 3/1999 Loo ..... A47F 5/0025 211/126.13
5,898,817 A * 4/1999 Salmon ..... A61G 11/002 108/145
5,927,540 A * 7/1999 Godlewski ..... G07F 17/0092 221/103
6,011,999 A * 1/2000 Holmes ..... E05B 65/46 312/215
6,471,080 B1 * 10/2002 Hoffmann ..... A47B 63/00 211/126.1
7,144,092 B1 * 12/2006 Chang ..... E05B 65/462 312/217
7,896,149 B2 3/2011 Tabata
8,085,135 B2 * 12/2011 Cohen Alloro ..... G06F 19/3462 340/309.16
8,090,472 B2 * 1/2012 Schifman ..... G07F 11/44 700/231
8,521,327 B2 8/2013 Pinney
2003/0001466 A1 1/2003 Herrington
2003/0201697 A1 10/2003 Richardson
2003/0222548 A1 12/2003 Richardson
2004/0100388 A1 * 5/2004 Yoshida ..... B60N 2/002 340/686.1
2007/0135965 A1 * 6/2007 Nguyen ..... A61G 12/001 700/231
2007/0221680 A1 9/2007 Yuyama
2008/0278043 A1 * 11/2008 Holcomb ..... E05B 65/46 312/219
2009/0114672 A1 * 5/2009 Schifman ..... G07F 11/44 221/133
2009/0266029 A1 * 10/2009 Kim ..... B65B 5/103 53/235
2010/0106291 A1 * 4/2010 Campbell ..... E05B 47/0002 700/231
2011/0140831 A1 6/2011 Michale
2013/0282171 A1 10/2013 Kim
2013/0325175 A1 12/2013 Rahilly

FOREIGN PATENT DOCUMENTS

WO WO 99/30248 6/1999
WO WO 2008/099253 A2 8/2008

OTHER PUBLICATIONS

European Search Report, Application No. 16174270.5, dated Aug. 17, 2016, 5 pages.
Chinese Office Action, Application No. 201710102068.4, dated Jul. 3, 2018, 4 pages.

* cited by examiner

BACK

STORAGE SYSTEM FOR SUPPLYING ARTICLES

RELATED APPLICATIONS

This application is a division of application Ser. No. 13/635,780 filed Nov. 30, 2012, which in turn is a National Phase entry of PCT Application No. PCT/GB2011/000383, filed Mar. 18, 2011, which claims priority from Great Britain Application Number 1004668.8, filed Mar. 19, 2010, the disclosures of which are hereby incorporated by reference herein in their entireties.

TECHNICAL FIELD

The invention relates to storage systems and apparatuses for supplying articles, such as for use in stock control systems, for example in manufacturing facilities and medical facilities, and for use as vending machines.

BACKGROUND

In typical automated stock control systems, a housing comprises a plurality of latched drawers. Articles to be supplied to users are provided in the drawers or compartments of the drawers. Examples of such articles include cutting tools and the like used with machine tools; other manufacturing tools and components; drugs, needles and other medical items; and legal documents. A control system allows a user to access the required article by unlatching the drawer containing the required article. The drawer is then pulled out from the home position (where no compartments are exposed) to the extent that the compartment containing the article is exposed, when the drawer is latched again to prevent further opening of the drawer. Such systems require complicated mechanisms for locking drawers closed in their home position, for unlocking the correct drawer and for allowing only that drawer to be opened, and then only to the extent that the required article is accessible.

In a known system, several trays are provided above one another in a housing, with each tray extending in the width direction of the housing. One or a number of drawers are provided on top of each tray, and a separate latch mechanism with separate control circuitry is provided in each tray for each drawer in that tray. In this system, it is not possible to remove individual drawers without removing the whole tray. Thus, restocking is generally carried out by opening the drawers and refilling the individual compartments. Moreover, modification of the layout of the drawers is often not easily practicable, with modified systems requiring the trays and housings to be redesigned and then built from scratch.

In other systems, drawers can only be removed by accessing the rear of the housing to release the drawers. In still other systems, drawers are removably dropped into movable carriers, with the movable carriers holding control electronics. Again, access to the rear of the housing is required to release drawers from carriers.

In general, improvements in the art have concentrated on the trays and drawer carriers. The prior art systems suffer the common problem that modification to meet particular customer needs, for example by resizing and reconfiguring drawers, is difficult and expensive. Moreover, the drawers cannot easily be removed for restocking or replacement. A further common problem is that the requirement to provide trays or movable carriers takes a large amount of space so that the systems have low storage density—in other words, the ratio of the usable storage volume to the volume of the apparatus as a whole is low. A yet further common problem is that current systems are expensive to manufacture.

SUMMARY

Embodiments substantially address the problems of the prior art systems. According to an embodiment, there is provided a cartridge for holding a plurality of drawers above one another, said cartridge comprising: an upright; and, provided on one side of the upright for each of the drawers: a guide block for mounting a respective drawer to one side of the cartridge; drawer information means for providing information on at least one of position and movement of the drawer; and a latch mechanism, which is electronically controllable, for engaging with a respective drawer, whereby access to the drawers can be controlled.

In an embodiment, the cartridge further comprises a circuit board mounted to the upright, each said drawer information means and each said latch mechanism being connected to circuitry on the circuit board.

In an embodiment, the circuitry is adapted to control opening and closing of each said latch mechanism based on information from the respective drawer information means.

In an embodiment, the drawer information means comprises sensing means for sensing an index member provided on the respective drawer.

In an embodiment, the guide block comprises an upper rail and a lower rail extending in a depth direction of the cartridge for engaging with corresponding rail-engaging means of the respective drawer for holding the respective drawer, and the drawer information means is disposed between said upper and lower rails.

In this case, the drawer information means can be disposed adjacent the upper rail.

In an embodiment, the upper rail comprises a first portion extending away from upright and second portion extending orthogonal to the first portion, and the lower rail comprises a third portion extending away from the upright and a fourth portion extending orthogonally to the third portion in the opposite direction to the second portion.

In an embodiment, the upper and lower rails are disposed at different distances from the upright.

In an embodiment, the latch mechanism comprises a solenoid, a solenoid flap, and biasing means for biasing the solenoid flap away from the solenoid to engage with one or more stops provided on the respective drawer.

In an embodiment, the cartridge further comprises an over-ride system, by means of which all the latch mechanisms can be manually opened together.

In an embodiment, the over-ride system comprises: a finger bar; and an over-ride bar pivotally connected to the finger bar, whereby movement of the finger bar moves the over-ride bar to open each latch mechanism.

In an embodiment, the over-ride bar comprises a chamfered portion provided for each latch mechanism, whereby movement of the over-ride bar causes the chamfered portion to move a flap of the respective latch mechanism against the action of respective biasing means.

In an embodiment, a drawer guide is mounted on the side of the upright opposite to the side on which the guide block, drawer information means and latch mechanism are mounted.

According to another embodiment, there is provided a drawer comprising: at least one compartment open at the top of the drawer; upper and lower rail-engaging means extending in a depth direction of the drawer for mounting a first side of the drawer adjacent a holding apparatus; and drawer information means disposed between the upper and lower rail-engaging means.

In an embodiment, the drawer information means is disposed adjacent the upper rail-engaging means.

In an embodiment, the drawer information means comprises an index member.

In an embodiment, the upper rail-engaging means is provided on the first side of the drawer and comprises a first portion extending away from the first side and a second portion extending orthogonally to the first portion; and the lower rail-engaging portion comprises a groove formed in the bottom of the drawer.

In an embodiment, each compartment comprises a cut out at the top of a second side opposite to the first side, whereby articles can be removed with a finger In an embodiment, a second side of at least one compartment opposite to the first side is curved whereby articles can be slid up the second side.

In an embodiment, the drawer includes a drawer release lever disposed at the back of drawer, the release lever being biased for latching the drawer to the holding apparatus.

In an embodiment, the drawer release lever is provided on the bottom of the drawer.

In an embodiment, the drawer also comprise a stop corresponding to each said compartment on the first side of the adapted to engage with a latch provided by the holding apparatus for controlling access to the respective compartment.

In an embodiment, the drawer also includes a lifting portion adapted to engage with lifting means provided by the holding apparatus to lift a back portion of the drawer.

In an embodiment, the lifting portion comprises a chamfer.

In an embodiment, the drawer further comprises a guide notch extending longitudinally along the top of the drawer and disposed towards a second side opposite the first side; and a guide protrusion extending longitudinally along bottom of drawer under the guide protrusion, whereby the guide protrusion of an upper drawer is adapted to engage with the guide notch of a lower drawer.

In an embodiment, the drawer has a plurality of compartments separated by respective compartment walls, the guide notch being formed in the top of compartment walls.

According to another embodiment, there is provided a method of making a drawer, the drawer comprising at least one compartment open at the top of the drawer; upper and lower rail-engaging means extending in a depth direction of the drawer for mounting a first side of the drawer adjacent a holding apparatus, the upper rail-engaging means being provided on the first side of the drawer and comprising a first portion extending away from the first side and a second portion extending orthogonally to the first portion and the lower rail-engaging portion comprising a groove formed in the bottom of the drawer; and a plurality of stops on the first side of the drawer, said stops corresponding to respective ones of the compartments and being adapted to engage with a latch apparatus for controlling access to the respective compartments, the method comprising: providing a mould for the drawer, and forming the drawer in one piece using injection-moulding without side action.

In an embodiment, the method further comprises mounting an index member adjacent the upper rail-engaging means.

In an embodiment, the method further comprises disposing the mould so that each compartment comprises a cut out at the top of a second side opposite to the first side, whereby articles can be removed with a finger.

In an embodiment, the method further comprises disposing the mould so that a second side of at least one compartment opposite to the first side is curved whereby articles can be slid up the second side.

In an embodiment, the method further comprises disposing the mould so that a guide notch extends longitudinally along the top of the drawer and is disposed towards a second side opposite the first side, and a guide protrusion extends longitudinally along bottom of drawer under the guide protrusion, whereby the guide protrusion of an upper drawer is adapted to engage with the guide notch of a lower drawer.

According to a yet further embodiment, there is provided a storage system comprising: a cartridge, said cartridge including an upright having mounted on one side a plurality of guide blocks; a plurality of first drawer information means; and a plurality of latch mechanisms, said system further comprising a plurality of drawers, each said drawer including guide block engaging means extending in a depth direction of the drawer for mounting a first side of the drawer adjacent a respective guide block; second drawer information means disposed adjacent the first drawer information means, said first and second information means for providing information on at least one of position and movement of said drawer; and at least one stop on the first side of the drawer for engaging with a said latch mechanism, wherein the latch mechanisms are electronically controllable for regulating access to the drawers.

In an embodiment, the length of guide block engaging means in the depth direction of the drawer is greater than the length of the guide block in the depth direction of the drawer.

In an embodiment, when the drawer is mounted the upper rail-engaging means is disposed adjacent to and between the upper rail and the first drawer information means, and the second drawer information means is disposed adjacent to the first drawer information means.

In an embodiment, the storage system further comprises a lockable cover plate for preventing access to the over-ride system.

In an embodiment, the drawer release lever is accessible only when all the latch mechanisms have been opened.

In an embodiment, when a said drawer is mounted to the cartridge, the bottom of the drawer and the bottom of the respective guide block are substantially adjacent.

In an embodiment, the storage system further comprises a housing for mounting the cartridge.

In an embodiment, the storage system comprises a plurality of cartridges.

In an embodiment, a width of a drawer mounted to a first cartridge is different from a width of a drawer mounted to a second cartridge.

In an embodiment, the drawer further comprises a lifting portion and the housing comprises a lifting means, wherein the lifting portion and the lifting means engage with one another when the drawer is in a home position in the housing to lift a back portion of the drawer. In an embodiment, the storage system comprises a plurality of cartridge mounting brackets, the cartridge mounting brackets extending in a width direction of the housing and being disposed above one another, wherein a plurality of cartridges is mounted to each cartridge mounting bracket.

In an embodiment, the storage system comprises centralised control means for controlling the circuitry of each said cartridge to control access to the content of each the drawers in the housing.

In an embodiment, when closed, none of the drawers touch each other and, during movement, a said drawer engages with the drawers above and below to constrain the movement vertically and laterally.

According to another embodiment, there is provided a storage system comprising a cartridge as set above and a drawer as set out above.

According to another embodiment, there is provided a modular storage system comprising: a housing; a plurality of cartridge mounting brackets extending in a width direction of the housing and being disposed substantially in parallel above one another; a plurality of cartridges mountable to each cartridge mounting bracket, each cartridge comprising an upright extending in a height direction of the housing; and a plurality of drawers mountable above one another to the cartridges.

In an embodiment, each cartridge mounting bracket comprises a plurality of cartridge alignment brackets, wherein the cartridges can be selectively mounted to the cartridge mounting brackets at selected alignment brackets.

In an embodiment, a first drawer mounted to a first cartridge has a different width to a second drawer mounted to a second cartridge. In an embodiment, the width of the first drawer is substantially an integral multiple of a width of the second drawer.

In an embodiment, a first drawer mounted to a first cartridge has a different height to a second drawer mounted to a second cartridge.

In an embodiment, a first drawer mounted to a first cartridge has a different height to a second drawer mounted to the first cartridge.

In an embodiment, the cartridges do not extend as far in the depth direction as the drawers.

In an embodiment, each cartridge comprises: at least one detector associated with each drawer with the detector being adapted and arranged to monitor when the drawer is in its fully closed position, to monitor the distance the drawer moves, and to monitor the direction of movement of the drawer; and a respective latch mechanism for each drawer so as to latch the drawer in the fully closed position and at respective open positions corresponding to the compartment to which access is allowed by the control means; the detector comprising an index member provided on the respective drawer and a sensor for interacting with the index member, and the system further comprising control means for controlling access to the content of the drawers, wherein one or more drawers is divided into a plurality of compartments and the control means controls access to the compartments.

In an embodiment, the control means includes a respective distributed processor for each cartridge.

In an embodiment, the modular storage system comprises an over-ride system for each cartridge, by means of which all the latch mechanisms of a respective cartridge can be manually opened together.

In an embodiment, a single lockable cover plate is mounted to a respective cartridge mounting bracket for preventing access to the over-ride system of each cartridge mounted to the respective cartridge mounting bracket.

BRIEF DESCRIPTION OF THE DRAWINGS

Embodiments will now be described by way of example only and with reference to the accompanying drawings, in which.

DETAILED DESCRIPTION

In the following specification, the terms front, back, rear, left, right, top, bottom, upper, lower and like terms will be used consistently with the arrangement shown in FIG. 1. In particular, the expression height corresponds to a dimension from top to bottom, width corresponds to a dimension from left to right and depth corresponds to a dimension from front to back.

Figure 1:
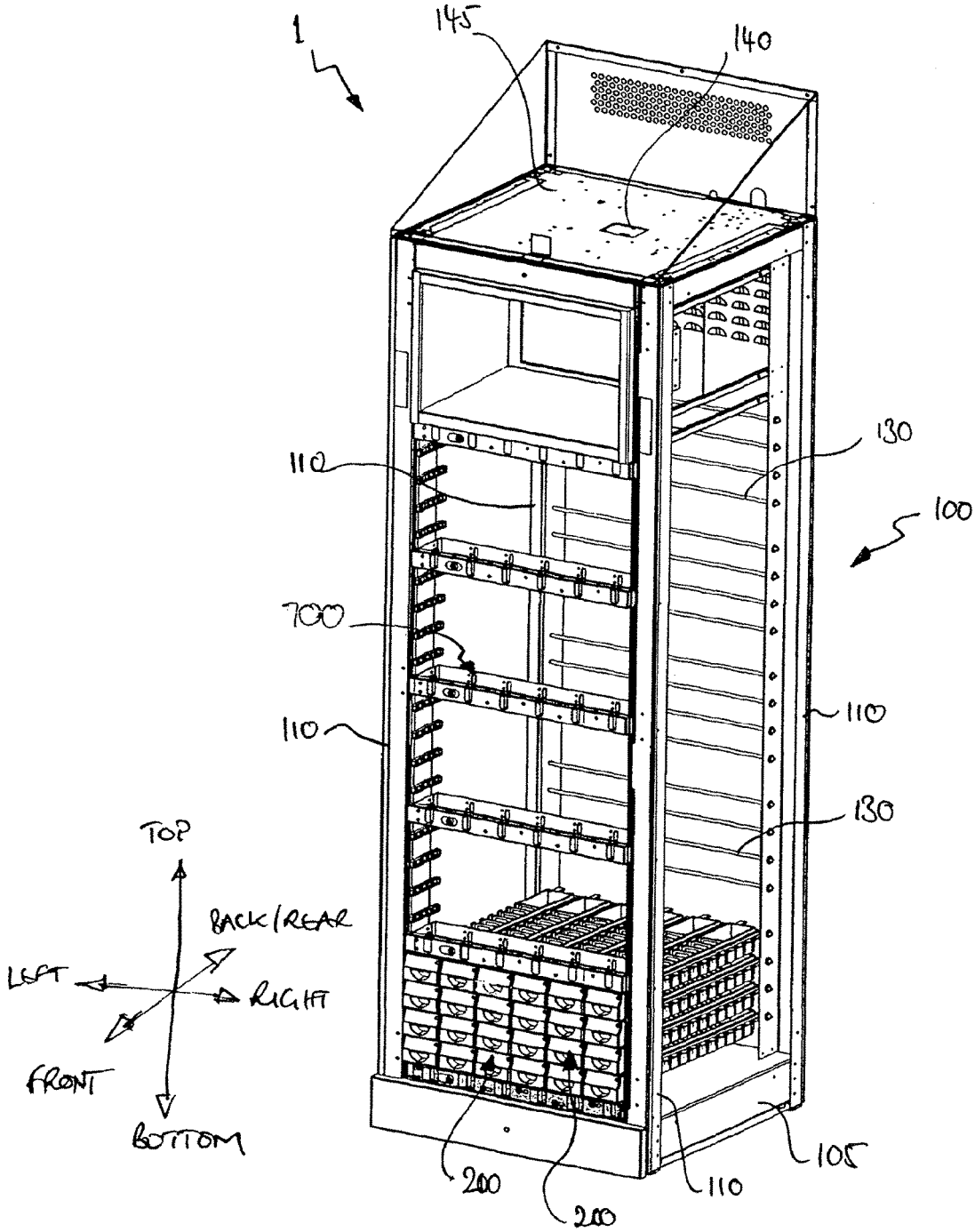
FIG. 1 is a perspective view of a modular supply system according to an embodiment.

FIG. 1 shows a perspective view of a modular supply system 1 according to an embodiment. In the system 1, a housing 100 is provided with a frame comprising a base 105 and four uprights 110 extending from respective corners of the base 105. Cartridge mounting brackets 700 (described in more detail below) are mounted to extend between the front uprights 110 and lifting beam 130 (described in more detail below) are mounted to extend between the rear uprights 110.

In FIG. 1, six cartridges 300 each holding four drawers 200 are mounted between the cartridge mounting bracket 700 on the base 105 and the cartridge mounting bracket 700 disposed directly above it. However, in practice cartridges 300 would also be mounted on the other cartridge mounting brackets 700 to fill the empty space in the housing 100 with drawers 200. Although not shown, side and back plates would also be mounted to the housing 100 to prevent unauthorised access to the drawers 200 and any electronics.

The housing 100 also has a system circuit board 145 with a system control circuit 140 mounted thereto. Wiring extends from the circuit board 145 down channels provided in the front uprights 110, along the cartridge mounting brackets 700 to circuitry provided in each of the cartridges 300 (described in more detail below).

Figure 2:
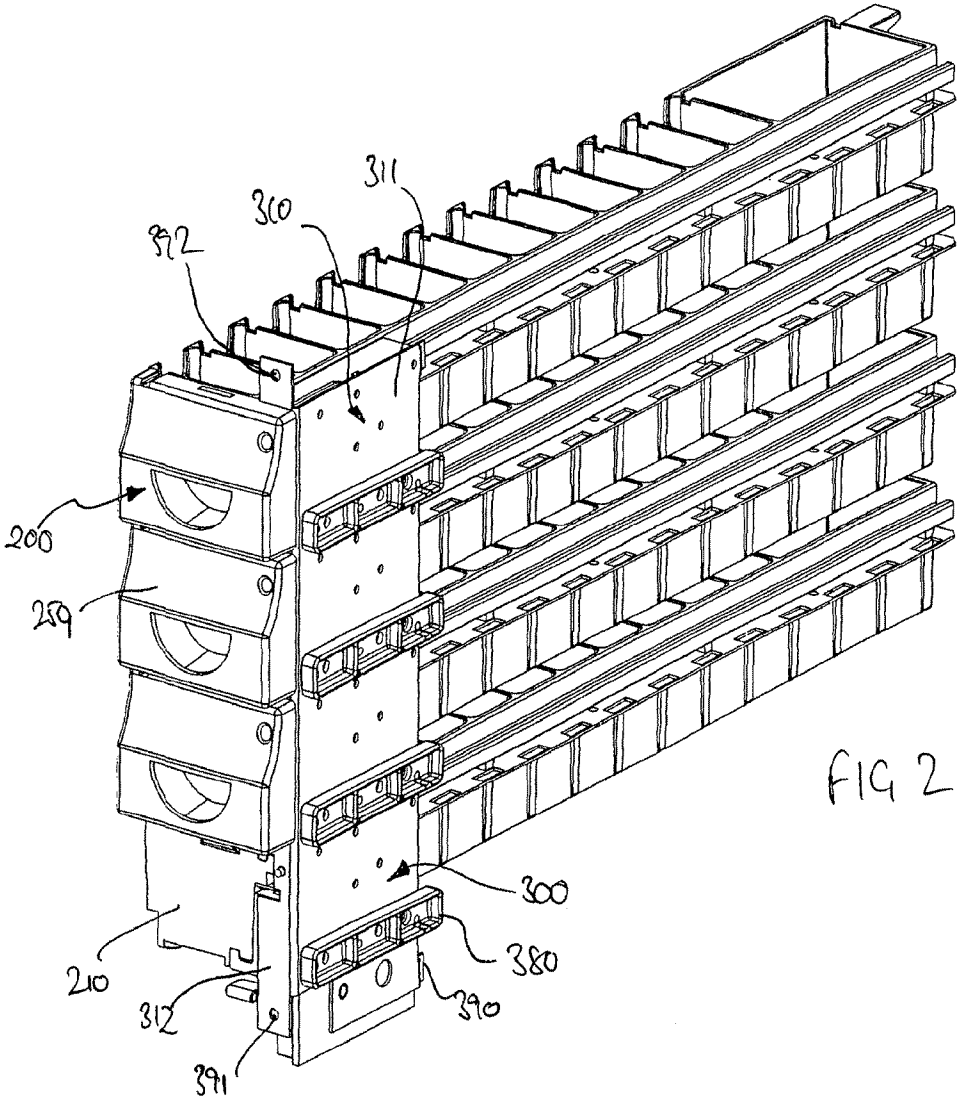
FIG. 2 is a perspective view of a cartridge and drawers with one of the drawer handles removed according to an embodiment.
Figure 5:
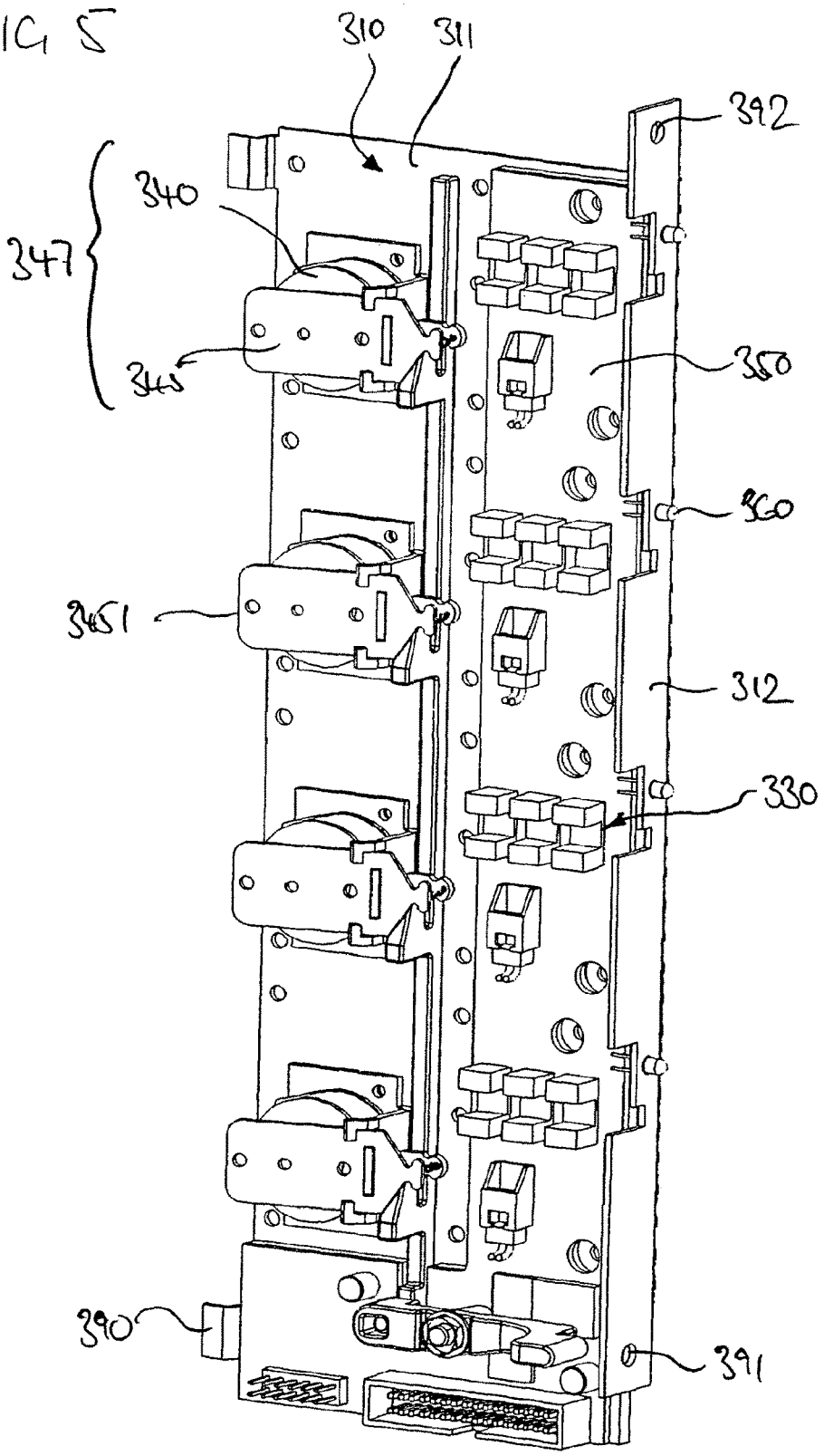
FIG. 5 is another perspective view of a cartridge, with all the guide blocks removed according to an embodiment.

As shown in more detail in FIG. 2, each cartridge 300 comprises an upright 310, which is substantially L-shaped in cross-section and is formed by a front plate 312 extending in the width direction and back plate 311 extending in the depth direction (see FIG. 5). In the present embodiment, each cartridge 300 holds four drawers 200 arranged above one another, each drawer 200 comprising a drawer body 210 and a drawer handle 259. The drawer handle 259 of the bottom drawer 200 has been removed in FIG. 2 for ease of reference.

Figure 3:
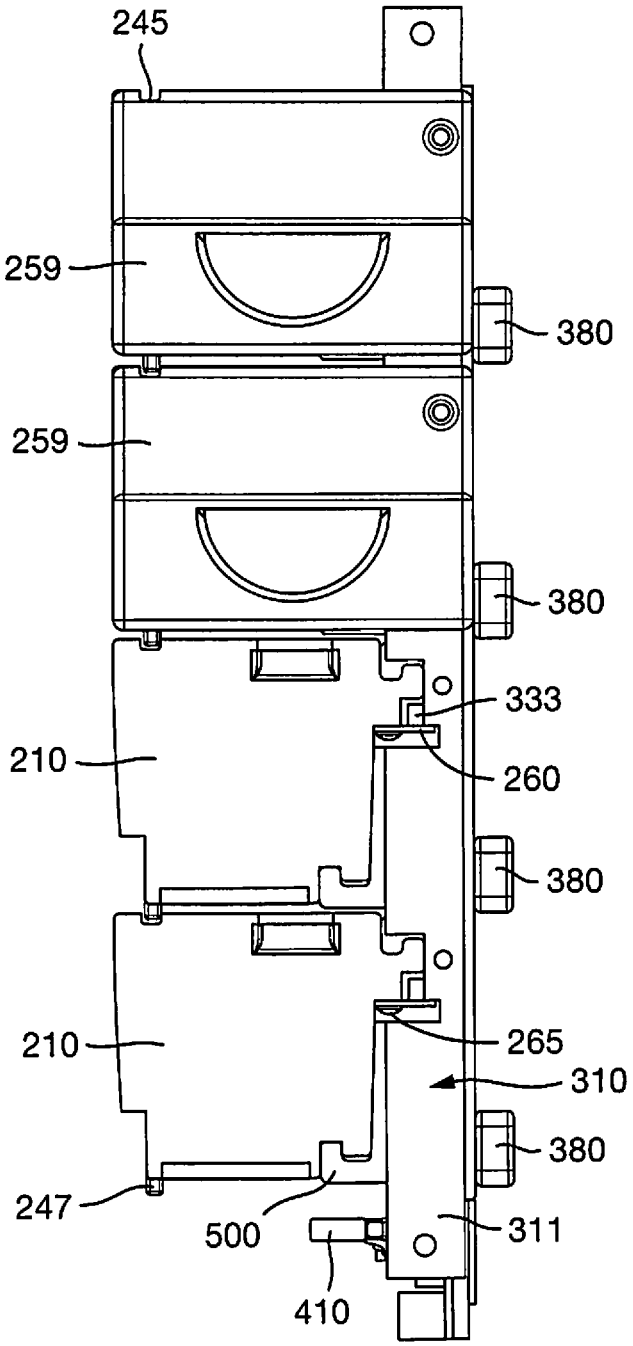
FIG. 3 is a front elevation of the cartridge and drawers shown in FIG. 2 with two of the drawer handles removed according to an embodiment.

FIG. 3 shows a front elevation of the cartridge 300 and drawers 200 shown in FIG. 2, but in this case the drawer handle 259 of the lower two drawers 200 has been removed. As the figure illustrates and as will become apparent from the following description, the cartridge 300 includes guide blocks 500 for holding the drawers 200 in a stacked arrangement with the drawers 200 stacked above one another. The drawers 200 and the guide blocks 500 are provided with a one-to-one correspondence.

Figure 6:
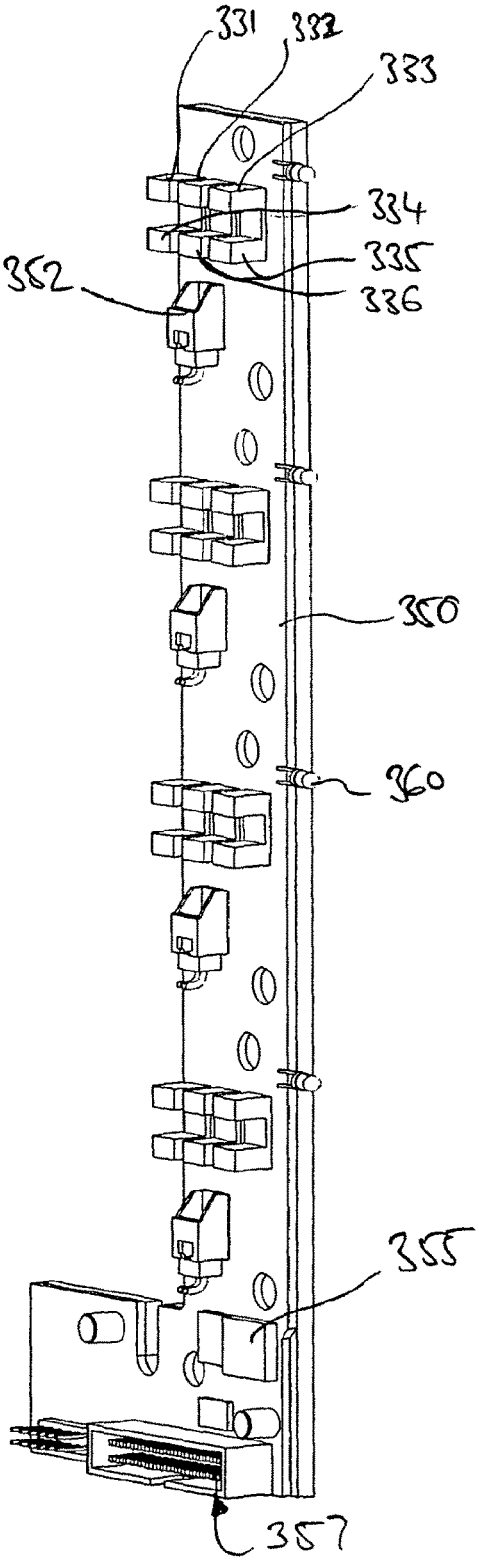
FIG. 6 is a perspective view of a cartridge circuit board according to an embodiment.

Perspective views of the cartridge 300 and its components from the left side are shown in FIGS. 4-8. It should be noted that in FIG. 4, one guide block 500 has been removed for ease of reference and in FIG. 5 all the guide blocks 500 have been removed. As shown in the figures, each cartridge 300 comprises a cartridge circuit board 350 and, for each of the drawers 200 to be mounted to the cartridge 300, a guide block 500, a solenoid 340 and a solenoid flap 345, the solenoid 340 and the solenoid flap 345 together forming a latch mechanism 347. As shown in FIG. 6, the cartridge circuit board 350 has mounted thereto a cartridge control circuit 355 and input/output (I/O) connectors 357 for connecting the cartridge circuit board 350 to the system circuit board 145. For each drawer 200 that can be mounted to the cartridge 300 there is also provided a solenoid connector 352 and a group of three sensors 330. The sensors 330 are arranged in a row extending from front to back. Each sensor 330 comprises a light emitting diode (LED) 331, 332, 333 and a light receiving means 334, 335, 336, with the LED being mounted directly above the corresponding light receiving means. Thus, the three LEDs 331, 332, 333 form an upper row and the three light receivers 334, 335, 336 form a lower row, with a channel between the two rows.

Figure 7:
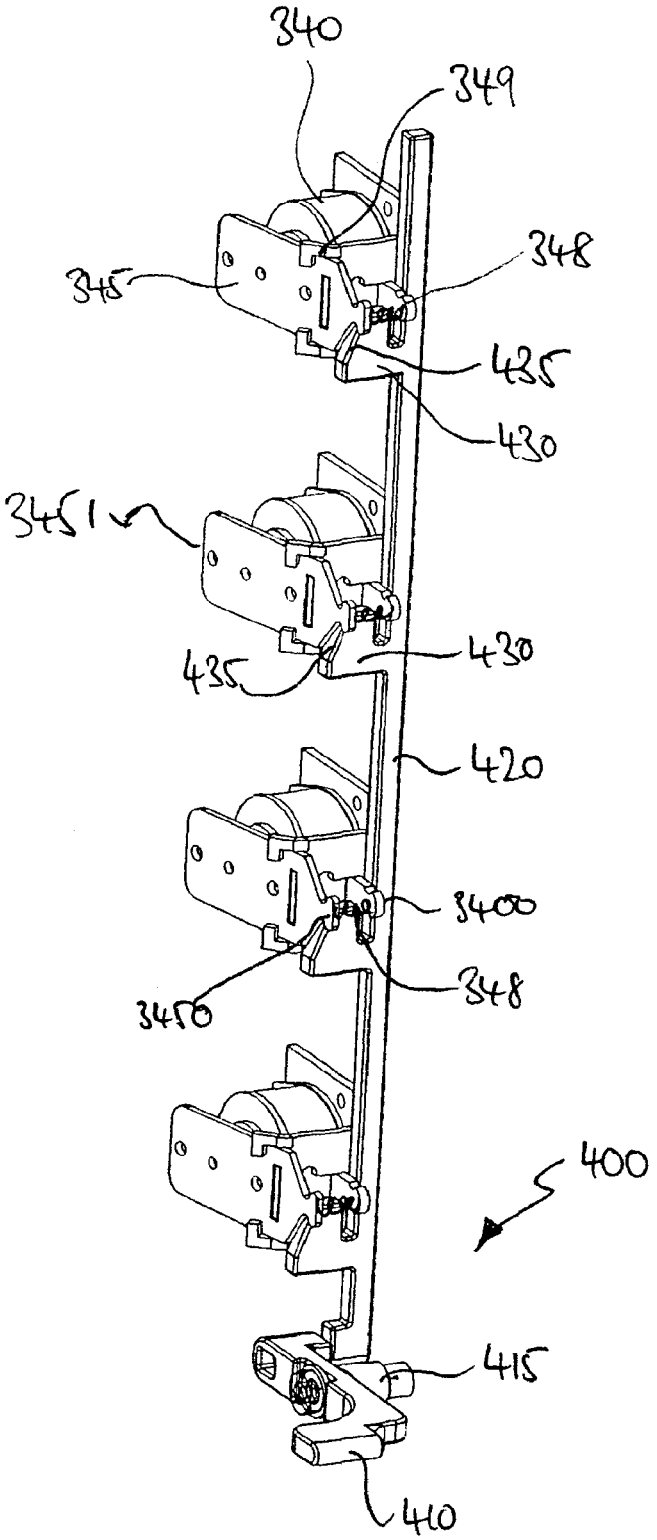
FIG. 7 is a perspective view of latch mechanisms and an over-ride system according to an embodiment.

As shown in FIG. 5, the cartridge circuit board 350 and the solenoids 340 are mounted to one wall of the upright 310 so that each solenoid 350 is adjacent a respective sensor group 300. As shown in FIG. 7, each solenoid 340 is provided with a solenoid flap 345 mounted by pivot 349, which together form a latch 347. The solenoid 340 is provided with a solenoid tab 3400 and the flap 345 is provided with a corresponding tab 3450, both the tabs 3400 and 3450 being provided on the opposite side of the pivot 349 to the solenoid main body and the flap main body. A spring 348 is provided between the tabs 3400 and 3450 to bias the main body of the flap 345 away from the solenoid 340. Accordingly, when the solenoid 340 is not activated, the solenoid flap 345 is disposed away from the solenoid and the latch 347 is closed. However, when the solenoid is activated, the resulting magnetic force attracts the flap 345 towards the solenoid 340 to open the latch 347.

As shown in FIGS. 5 and 7, the cartridge 300 is also provided with a manual latch over-ride system (solenoid over-ride system) 400. The over-ride system 400 comprises a finger bar 410 pivotally mounted to an over-ride bar 420. The finger bar 410 is mounted to the cartridge 300 upright 310 at pivot 415. The pivot 415 can be sprung so that the back side of the finger bar, attached to the over-ride bar 420 is biased downwards and the front side of the finger bar is biased upwards.

The over-ride bar 420 is provided with projections 430 disposed along its length, each projection 420 being disposed at least in part during operation of the over-ride system 400 between the solenoid tab 3400 and the solenoid flap tab 3450. Each projection 430 is provided with a chamfered portion 435, such that the projection 430 projects further from the over-ride bar 420 with increasing distance from the top of the bar. Thus, when front portion of the finger bar is pressed downward and the over-ride bar 420 moves upwards, the thicker parts of the projections 420 move between the respective solenoid and solenoid flap tabs 3400 and 3450 to move the main bodies of the flaps 345 towards the solenoids 340. In this way, all of the latches on the cartridge 300 can be opened simultaneously.

Figure 4:
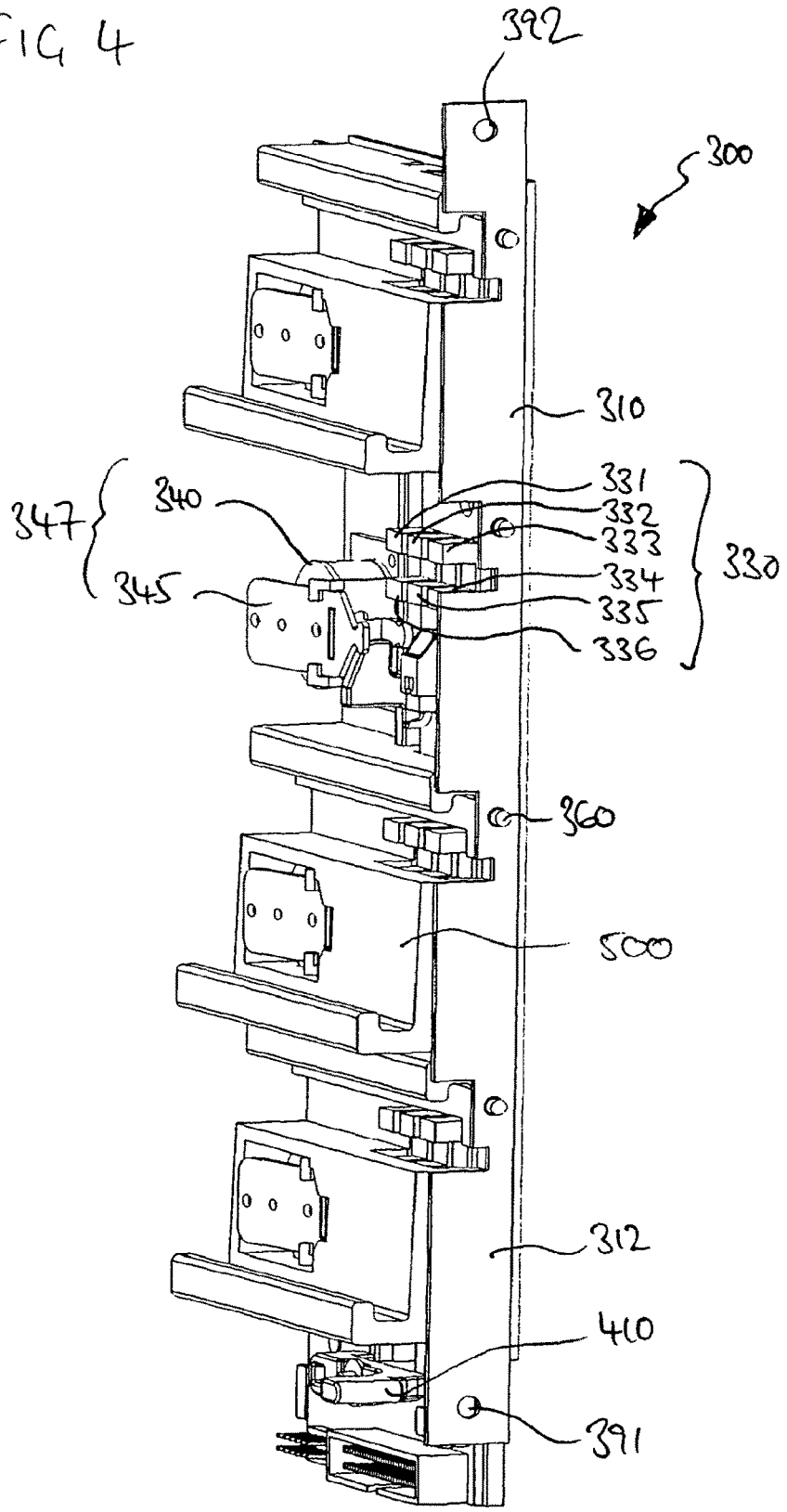
FIG. 4 is a perspective view of a cartridge, with one guide block removed according to an embodiment.

As shown in FIG. 4, a guide block 500 is mounted over each sensor group 330 and latch mechanism 347. However, the guide block 500 is provided with windows 530, 535 (see FIG. 8) to allow the solenoid flap 345 and the LEDs 331, 332, 333 to protrude (see FIG. 3).

Figure 8:
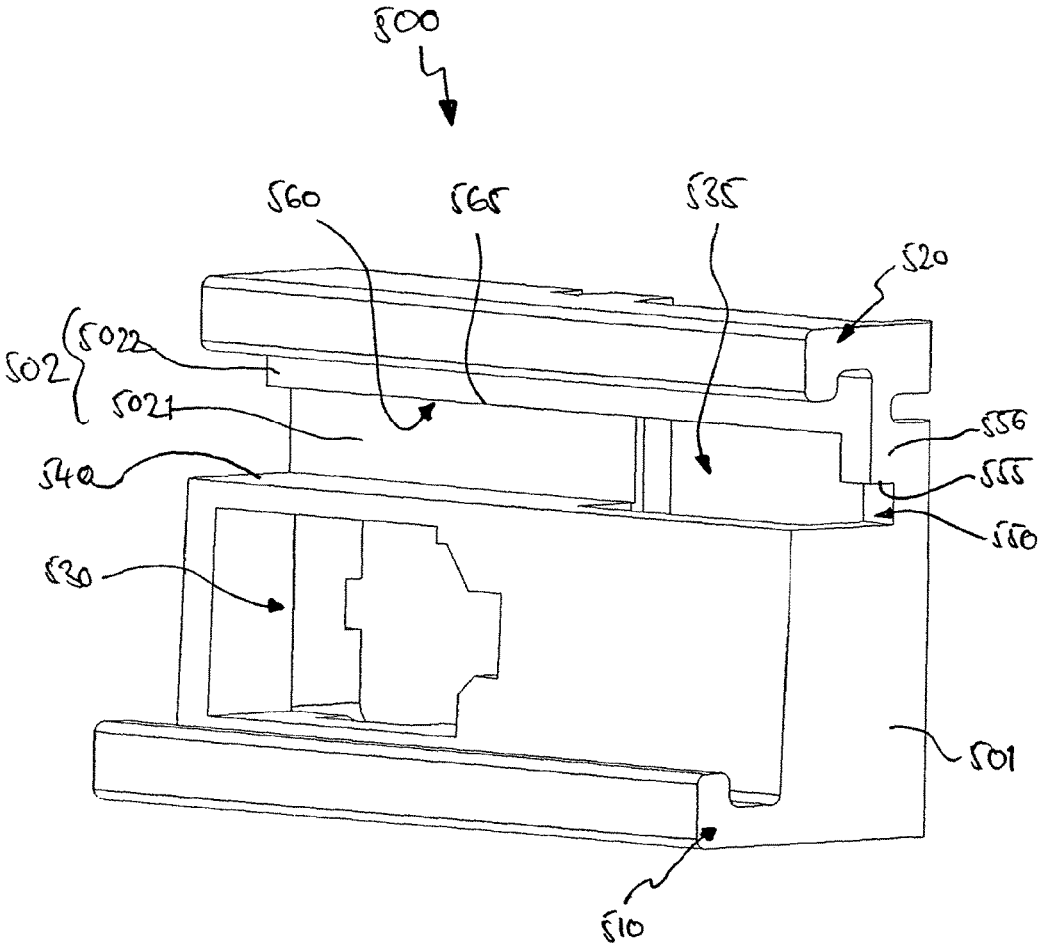
FIG. 8 is a perspective view of a guide block shown in FIG. 4 according to an embodiment.
Figure 9A:
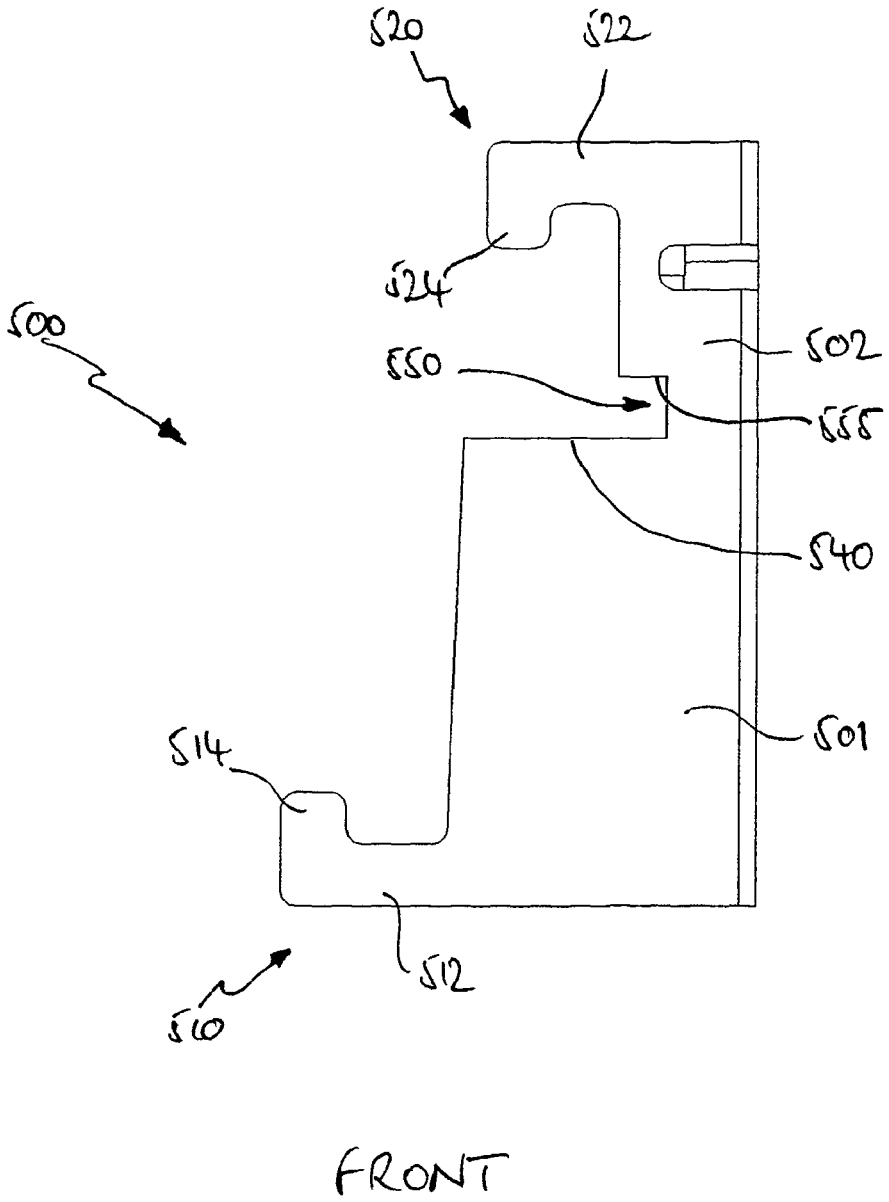
FIG. 9A is a front elevation of a guide block shown in FIG. 4 according to an embodiment.
Figure 9B:
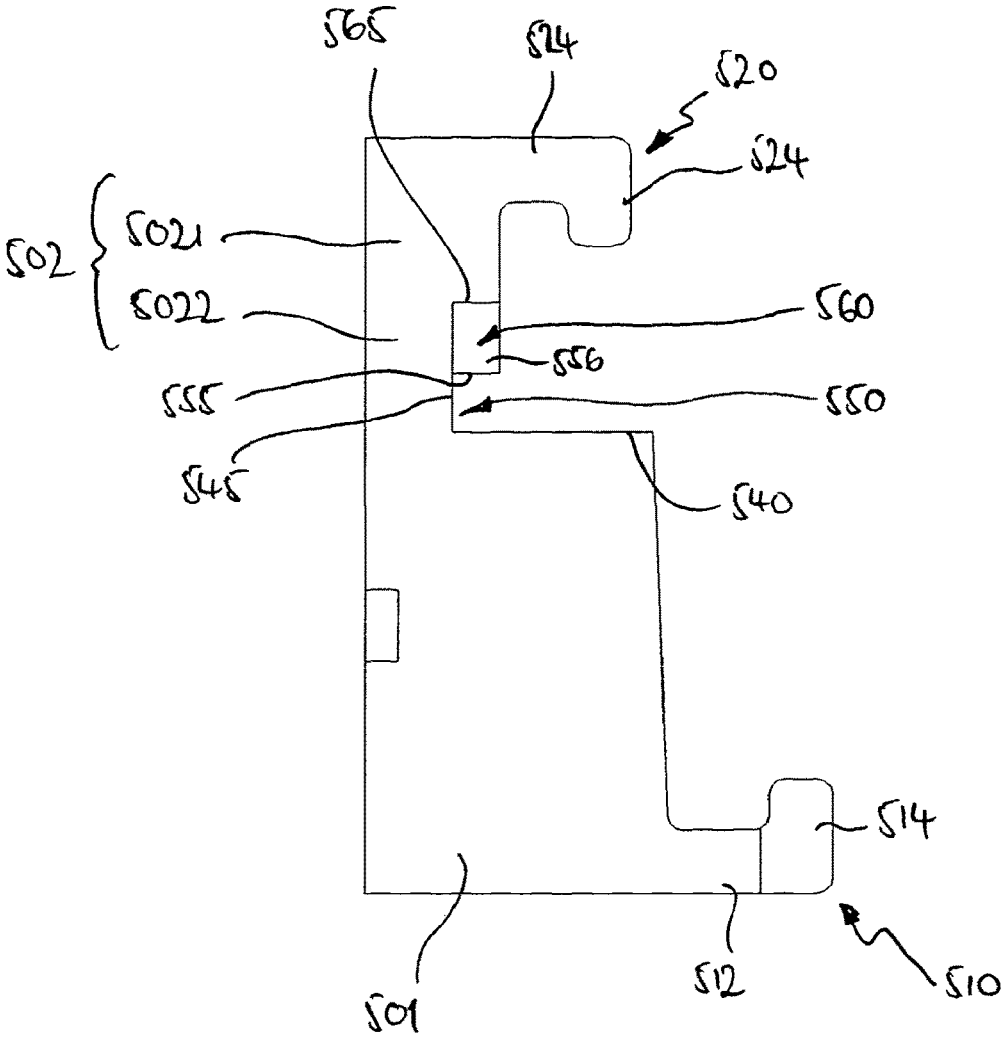
FIG. 9B is a rear elevation of a guide block shown in FIG. 4 according to an embodiment.
Figure 10:
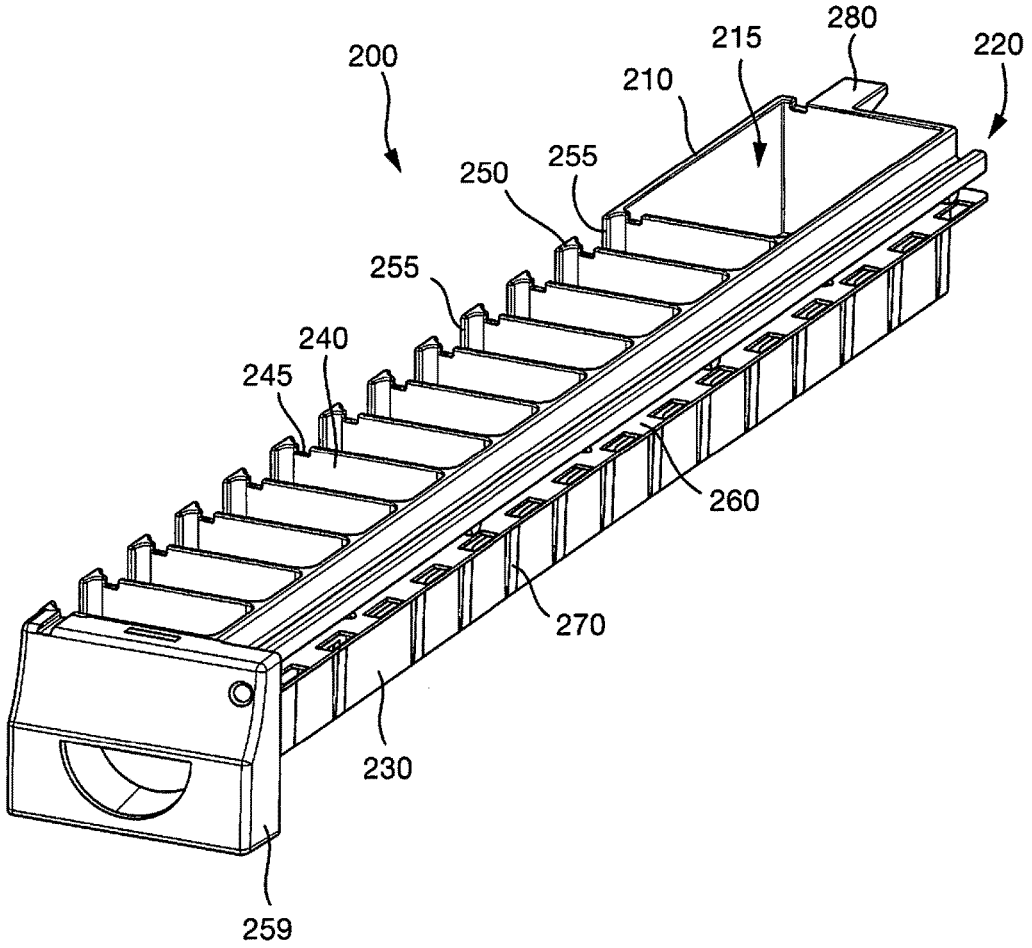
FIG. 10 is a perspective view of a drawer according to an embodiment.
Figure 11:
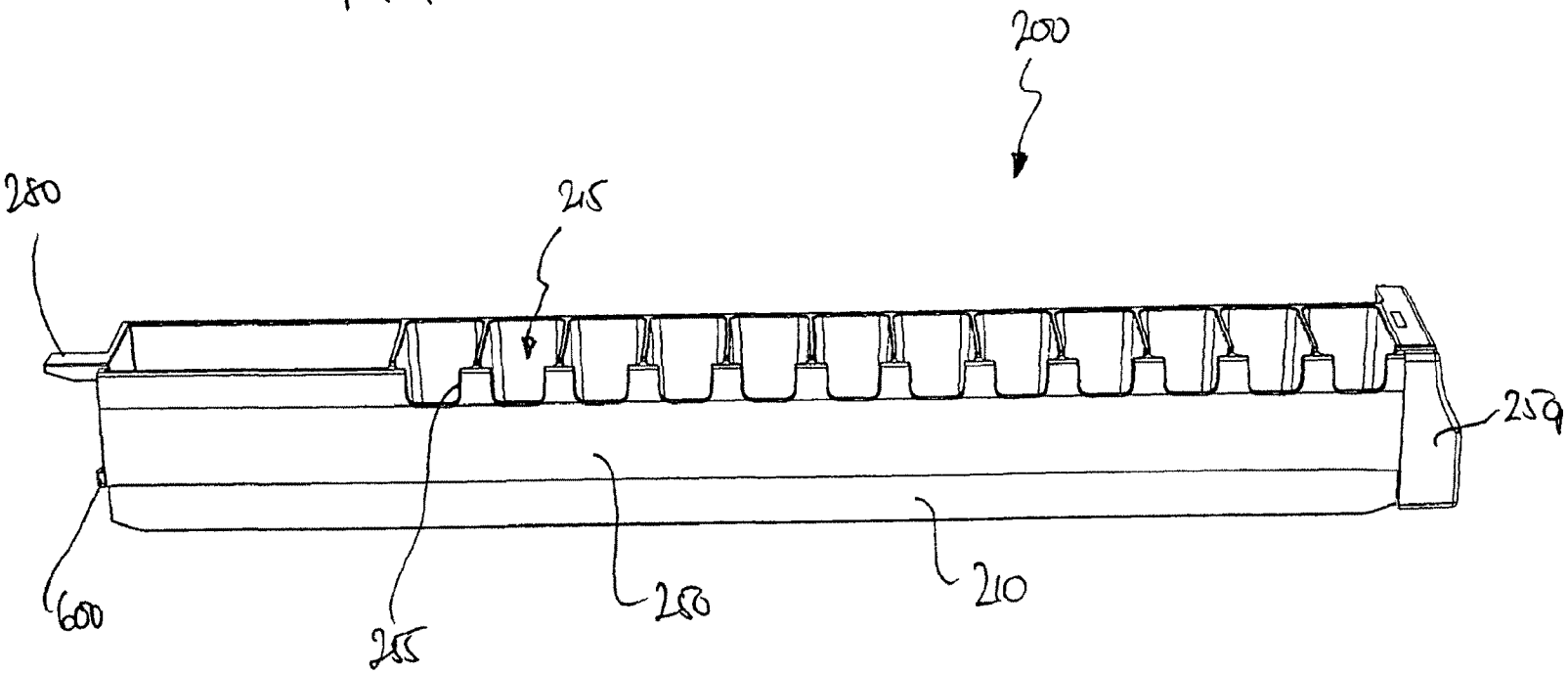
FIG. 11 is another perspective view of the drawer shown in FIG. 10 according to an embodiment.

As illustrated in FIGS. 8, 9A and 9B, each guide block 500 includes a stepped body in which the lower portion 501 of the body is thicker than the upper portion 502. Accordingly, there is a substantially horizontal, upward-facing surface 540 between the upper and lower portions 501, 502. An upper rail 520 and a lower rail 510 are provided and are adapted to engage with corresponding portions of the drawer (described later). The upper rail 520 comprises a leftward projecting portion 522, projecting substantially horizontally from the upper portion 502, and a downward projecting portion 524 to form a U-shaped groove. Similarly, the lower rail 510 comprises a leftward projecting portion 512, projecting substantially horizontally from the lower portion 501 and an upward projecting portion 514 to form a U-shaped groove. Both the upper and lower rails 510, 520 extend in the depth direction. It should be noted that since the lower portion 501 of the guide block 500 is thicker than the upper portion 502, when the guide block 500 is mounted to the rear plate 311 of the upright 310, the upper rail 520 is closer than the lower rail 510 to the rear plate 311.

The upper portion 502 is itself stepped, and comprises a thicker upper portion 5021 and thinner lower portion 5022 (see FIGS. 8 and 9B). Accordingly, there is a substantially horizontal, downward-facing surface 565 between the thicker upper portion 5021 and the thinner lower portion 5022 and a cavity 560 formed between the upward-facing surface 540 and the downward-facing surface 565. The downward-facing surface 565 extends from the rear of the guide block 500 almost to the front wall. However, a front wall portion 556 is formed at an upper part of the cavity 560 to extend downwards from downward-facing surface 565. Accordingly, a corner is formed by the downward-facing surface 565 and the rear surface of the front wall portion 556.

The front wall portion 556 does not extend downwards as far as the upward-facing surface 540. Accordingly, there is a notch 550 formed between the upward-facing surface 540, the inner surface 545 of the lower thinner portion 5022 and the lower surface 555 of the front wall portion 556. This notch 550 extends in a depth direction from the front of the guide block 500, and conceptually through the cavity 560 to the back of the guide block 500.

When the guide block 500 is mounted to the upright 310, the solenoid flap 345 protrudes through window 530 so that it is able to latch the drawer mounted to the guide block 500, as explained below. In addition, each of the sensors 530 is exposed through window 535. More particularly, the front-most LED 333 is disposed in the corner formed by the downward-facing surface 565 and the rear surface of the front wall portion 556, so that it is protected by the front wall portion 556 from tampering or accidental damage. The next two LEDs 331, 332 are disposed in the row behind the front LED 333 in the cavity 560. In addition, the three light receiving means 334, 335, 336 are disposed within the block below the respective LEDs, with their upper surfaces exposed through the window 535 and, in an embodiment, substantially flush with the upward-facing surface 540. Accordingly, the channel between the upper row of LEDs 331, 332, 333 and the lower row of light receivers 334, 335, 336 is aligned with the notch 550.

As shown in FIGS. 10-14, each of the drawers 200 comprises a main body 210 with a handle 259 and an index member 260 mounted thereto. The drawer main body 210 is formed as a single piece from a hard plastic material by injection moulding without side action. In particular, the drawer main body 210 comprises a plurality of compartments 215 open to the top, the compartments 215 being separated by compartment walls 240. A latch stop 270 is formed for each compartment 215 on the right-hand side wall 230 of the main body 210, which is the side that is mounted adjacent the cartridge 300. On the opposite side, a finger-sized cut-out 255 is formed at the top of the left-hand side wall 250 corresponding to each compartment 215 (see FIG. 11).

Figure 12:
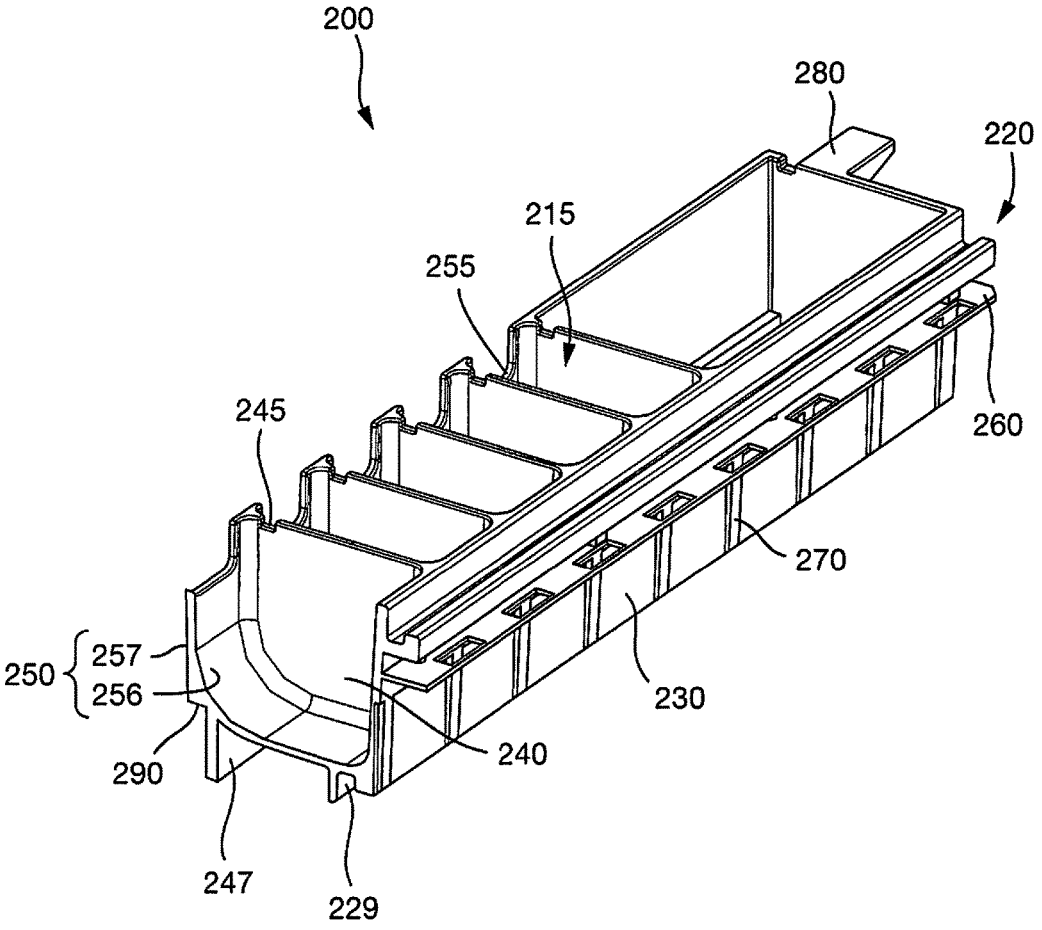
FIG. 12 is a perspective sectional view of the drawer shown in FIG. 10 according to an embodiment.
Figure 13:
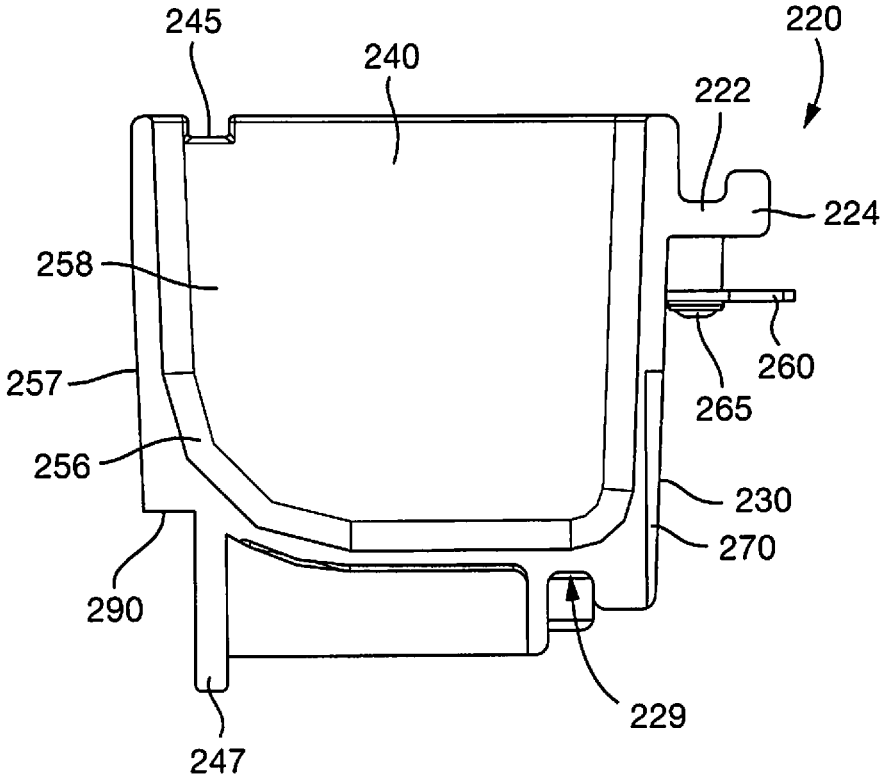
FIG. 13 is a front sectional view of the drawer shown in FIG. 10 according to an embodiment.
Figure 14:
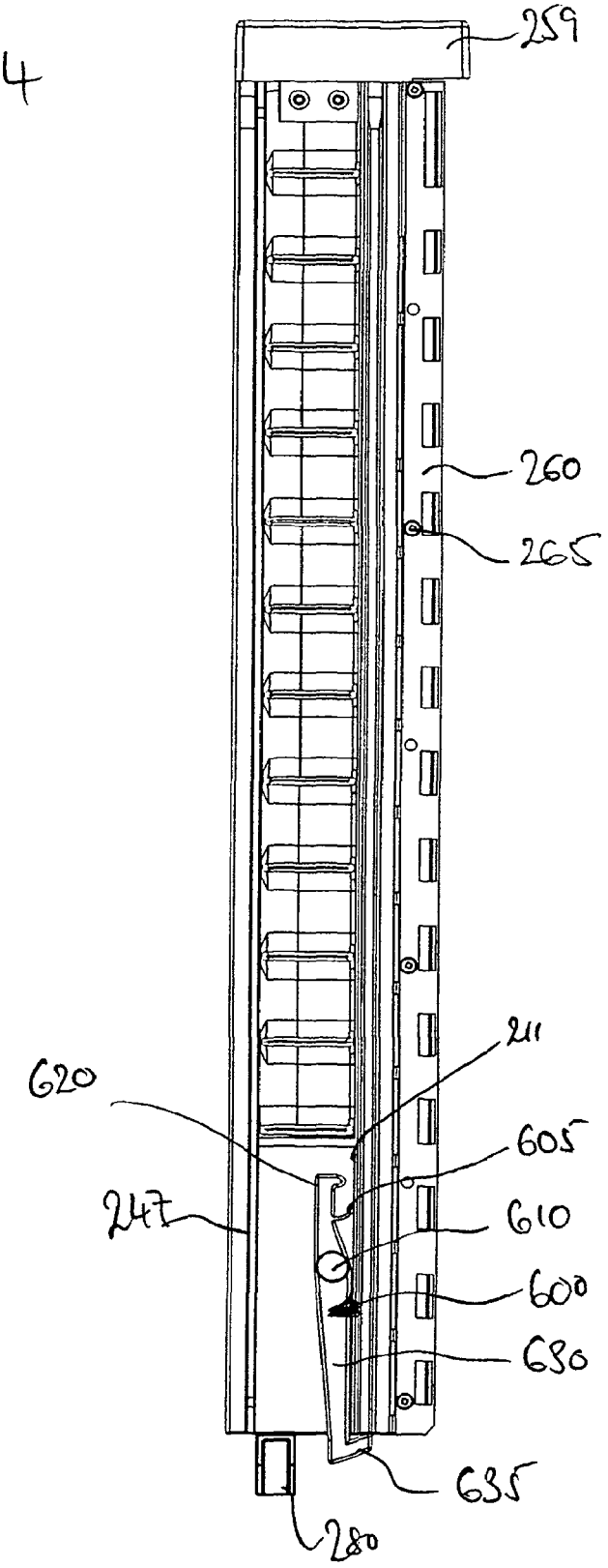
FIG. 14 is a view of the bottom of the drawer shown in FIG. 10 according to an embodiment.

As shown in the perspective cross-section of FIG. 12 and the front cross-section of FIG. 13, the side wall 250 comprises an outer surface 257 and an inner surface 256. The inner surface 256 is curved from the top of the side wall 250 to smoothly blend with the bottom of the compartments 215. In addition, the corners between the inner surface 256 of the left-hand side wall 250 and the compartment walls 240, and the corners between the bottom of each compartment 215 and the compartment walls 240 are rounded. The combination of the cut-outs 255, the curved left-hand side and bottom walls within each compartment 215, and the rounded corners with each compartment 215 allows a user to place his finger in the cut-out 255 and slide an article within the compartment 215 up the side wall 250 and out of the compartment 215. Such an arrangement is particularly advantageous when the articles stored in the compartments 215 are small and fiddly, such as medicinal tablets or small components such as screws, washers and so forth.

The main body 210 also includes an upper rail-engaging portion 220 adapted to engage with the upper guide rail 520 of the guide block 500. The upper rail-engaging portion 220 comprises a rightward projecting portion 222, projecting substantially horizontally from an upper portion of the side wall 230, and a upward projecting portion 224 to form a U-shaped groove. In addition, a groove 229 is formed on the bottom of the drawer 200 adjacent the right-hand side wall 230 as a lower rail-engaging portion.

When the drawer 200 is mounted to the guide block 500 (see FIG. 3), the upward projecting portion 224 of the rail-engaging portion 220 is disposed in the U-shaped groove formed by the upper rail 520 of the guide block 500. Similarly, the downward projecting portion 524 of the upper rail 520 is disposed in the U-shaped groove formed by the upper rail-engaging portion 220. Moreover, the upward projecting portion 214 of the lower rail 510 is disposed in the groove 229 formed on the bottom of the drawer 200. Since the upper and lower rail-engaging portions 220, 229 extend substantially longitudinally along substantially the entire depth of the drawer 200, and the lower and upper rails 510, 520 of the guide block 500 also extend in the depth direction, the above-described arrangement allows the drawer 200 to be held entirely by the guide block 500, with one side wall 230 held adjacent the guide block 500. As shown in FIG. 3, for example, no additional support is needed to hold the drawer 200 in place. Moreover, the drawer 200 is able to slide along the rails 510, 520 from its home position (the closed position of all the drawers 200 shown in FIG. 1) to an extended position in which the drawer 200 is pulled out.

As shown in FIGS. 3, 10 and 12-14, the index member 260 is a raster strip fitted to the drawer main body 210 by means of screws 265. In the embodiment, the raster strip 260 is a metal bar with holes cut out at predetermined intervals. The holes are all the same size and are shorter than the row of sensors 330, except for the front hole, which is longer than the row of sensors 330. The raster strip 260 is mounted to the drawer main body 210 adjacent the upper rail-engaging portion 520 at a height such that, when the drawer 200 is mounted to the cartridge 300, the raster strip 260 is disposed in the channel between the row of LEDs 331, 332, 333 and the row of light receivers 334, 335,336. In this way, as the drawer 200 is opened and closed, the raster strip 260 slides through this channel, the cavity 560 and the notch 550. As the drawer 200 moves, the solid portions of the raster strip 260 occlude light and the holes pass light emitted by the LEDs 331, 332, 333 so that the light received by the light receivers 334, 335, 336 changes with movement of the drawer 200. The front hole is longer than the row of sensors 330 so that none of the light from any of the LEDs 331, 332, 333 is occluded from the raster strip 260 when the drawer 200 is closed (that is, in the home position). Since the front hole is the only hole longer than the row of sensors, it can therefore be used to detect whether the drawer 200 is in the home position. The holes and the sensors 330 are sized and spaced so that the pattern of occlusion as the drawer 200 is moved allows the control circuitry (either the system control circuit 140 or the cartridge control circuit 355) to determine whether the drawer 200 is in the home position and, if not, how far from the home position it has moved, how fast it is moving and in which direction it is moving.

In some embodiments, the guide block 500 is sufficiently long, the tolerances of the guide block 500 and the drawer 200 are sufficiently small and the gaps between the rails 510, 520 and the rail-engaging portions 220, 229 are small enough that no other guidance or support for the drawers 200 in a cartridge 300 is required. However, in the present embodiment each of the drawers 200 is further provided with a guidance notch 245 in the top of and to the left-hand side of each of the compartment walls 240 and the drawer handle 259. A corresponding projection is formed to extend substantially longitudinally along the bottom of the drawer 200 directly below the notches 245, thereby forming a guidance rail 247. The guidance rail 247 is sized to fit in the notches 245. Accordingly, when the drawers 200 are mounted to the cartridge 300 in the stacked arrangement, the guidance rail 247 of an upper drawer 200 is disposed in the guidance notches 245 of a lower drawer 200 (see FIG. 3). This arrangement provides guidance for the drawers 200 as they are opened and closed and stops them from becoming skewed.

In one embodiment, the bottom of an upper drawer 200 rests on the top of a lower drawer 200 and/or the bottom of the guidance rail 247 rests on the bottom of the notches as the drawer 200 is pulled out. Alternatively, upper draws can rest on lower drawers 200 at all times. However, neither case is essential and the full weight of the drawers 200 can always be supported by the guide block 500 alone, for example.

Contact between upper and lower drawers 200 presents the potential problem that the weight of a number of upper drawers 200 may make it difficult to open a lower drawer 200. This potential problem is addressed in two ways in the present embodiment, although both are optional in other embodiments.

Figure 17:
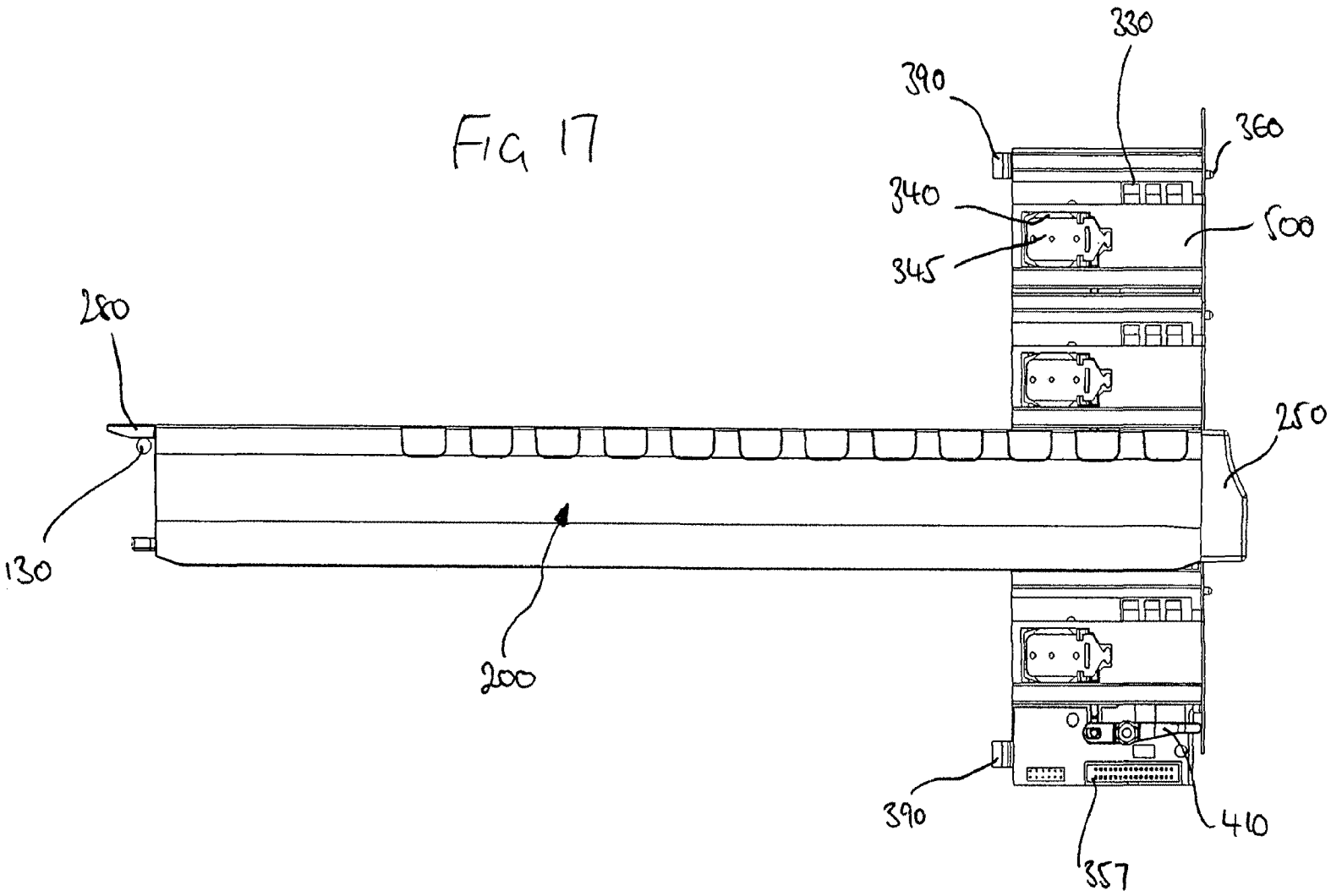
FIG. 17 is a side view of a cartridge, a drawer and a lifting beam according to an embodiment.
Figure 18:
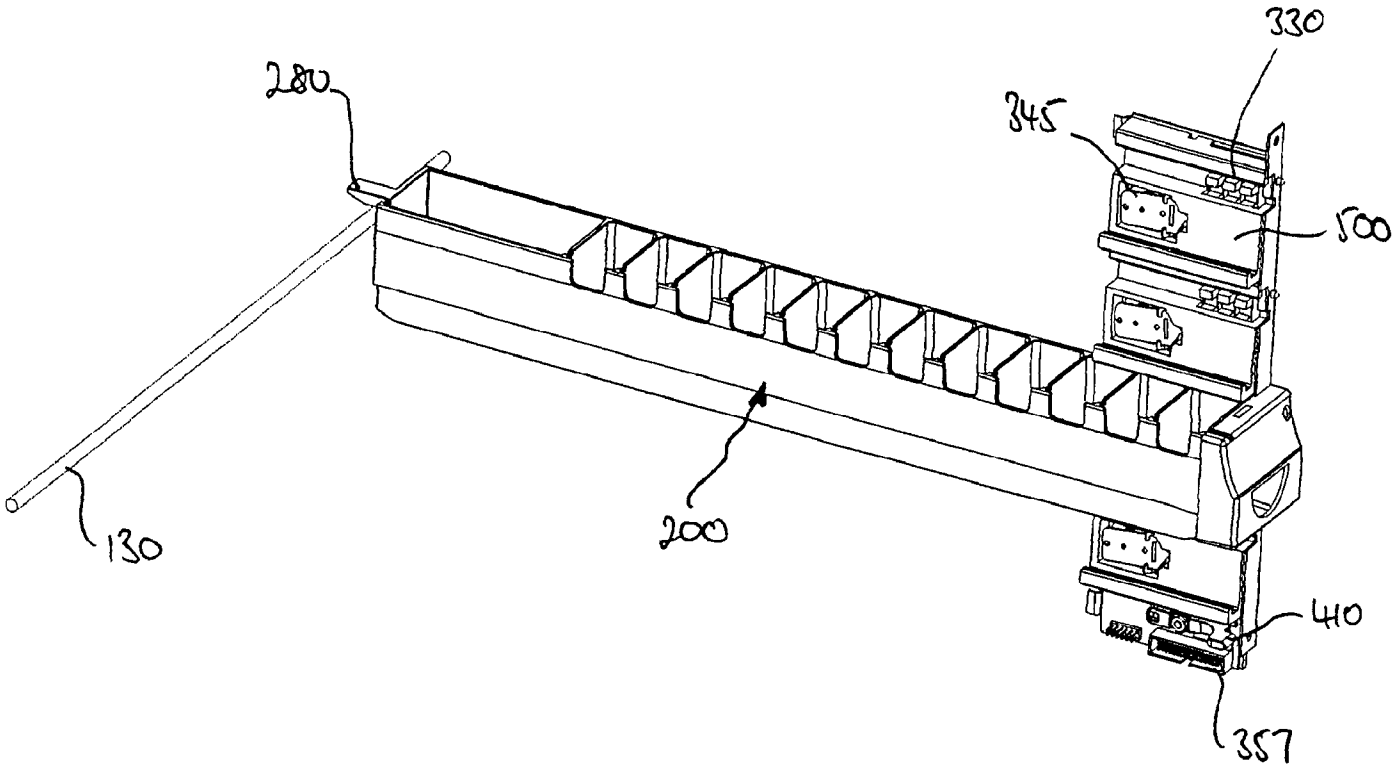
FIG. 18 is a perspective view of the cartridge, the drawer and the lifting beam shown in FIG. 17 according to an embodiment.

First, each drawer 200 is provided with a lifting tab 280 extending backwards from the back wall of the main body 210. The lifting tab comprises a chamfer on its underside (see FIGS. 12, 17 and 18). When the drawer 200 is moved back to its home position, engagement of the chamfer with the respective lifting beam 130 at the back of the housing 100 lifts the back end of the drawer 200 upwards to ensure that it does not rest on the drawer 200 below it. The guidance rail 247 can still be maintained in position in the notches 245, although it need not be.

Second, the upright 310 of the cartridge 300 is provided on the side opposite the guide blocks 500 with a drawer guide 380 for each drawer 200. In addition, the lower left corner of the drawer main body 210 is formed with a cut-away extending longitudinally along the substantially the entire depth of the drawer 200. When the drawer 200 is mounted to a first cartridge 300, the downward facing surface 290 of the cut-away rests on the respective drawer guide 380 provided on an adjacent cartridge 300. In this manner, at least a part of the drawer 200 can be supported on the drawer guide 380 both in the home position and when the drawer 200 is partially or fully open.

Accordingly, when the drawer 200 is in the home position, it is held by the lifting tab 280, the guide block 500 and the drawer guide 380 on an adjacent cartridge 300. In this manner, its weight does not bear on lower drawers 200, making the lower drawers 200 easy to open, irrespective of the weight of the articles stored in the drawers 200 or the number of drawers 200 above. However, the guiding function of the upper and lower rails 510, 520 of the guide block 500 and of the guidance rail 247 in the notches 245 is maintained. In an embodiment, the lower left-hand corner cut-away of the drawer 200 and the drawer guide 380 are also sized to provide an additional guiding function.

It should be noted that the guiding and supporting function of the guide block 500 can be improved by increasing its depth relative to the depth of the drawers 200. However, there is a trade-off in additional cost versus improved stability.

Returning to the description of the latch mechanism 247, the tab 3450 of each solenoid flap 345 is disposed toward the front side of the cartridge 300. In this way, the backward facing edge 3451 of each flap 345 protrudes slightly out of the guide block 500 (see FIGS. 5 & 18). When the drawer 200 is mounted to the guide block 500 from the front and slid to its home position, each of the stops 270 provided on the right-hand side wall 230 of the drawer 200 slides over the flap against the biasing force of the spring 348. However, when a user attempts to pull a drawer 200 out of the housing to access an article in a compartment 215, the backward facing edge 3451 of the flap 345 abuts a respective stop 270 to prevent the drawer 200 from being withdrawn. Thus, the drawer 200 is latched. However, the solenoid 340 may be activated by the control circuit 355 to attract the flap 345 towards it. This has the effect of preventing abutment of the backwards facing edge 3451 with the stops 270, to unlatch the drawer 200 and allow it to be pulled out.

The materials selected for the manufacture of the flap 345 and drawer 200 are also important. If both the flap 345 and the drawer 200 or drawer stop 270 are made of steel, the solenoid 340 may not always activate. However, if the solenoid flap 345 is made of steel and the drawer 200 or drawer stop 270 of plastic (or even copper), the resultant break in the electromagnetic field ensures the correct operation of the solenoid flap 345 with a smaller solenoid 340. Thus, a solenoid 340 with fewer windings, a smaller excitation current, or both can be used, thereby saving on cost of manufacture and/or running whilst improving operability. It will be recollected that the sensors 330 and the index member 260 can be used to detect whether the drawer 200 is in the home position, as well as the direction and speed of movement of the drawer 200, or the distance traveled by the drawer 200. This information can be used to control timing of activation of the solenoid 340 and thereby control a user's access to a particular compartment 215 in the drawer 200. For example, if the drawer 200 is in the home position and it is decided to grant a user access to the third compartment 215 from the front of a drawer 200, information derived from the sensors 330 can be used to control the solenoid 340 to retract the flap 345 until the drawer 200 is pulled out to the extent that the stop 270 corresponding to the second compartment 215 has passed the backward facing edge 3451 of the flap 345, and then to release the flap 345; alternatively, the flap 345 may also be released earlier if it is determined that the drawer 200 is being opened at a sufficient speed. The spring 348 then biases the backward facing edge 3451 to protrude out (or further out) of the guide block 500 window 530 so that as the drawer 200 is pulled out further the stop 270 corresponding to the third compartment 215 abuts the backward facing edge 3451 of the flap 345. In this way, the user can remove any article(s) stored in the third compartment 215 (as well as the first and second compartments 215). However, since he cannot pull the drawer 200 out further, he cannot access the compartments 215 that are further back.

Each drawer 200 is further provided with a drawer release lever 600 attached by pivot 610 to its underside (see FIG. 14) with a front portion 620 in front of the pivot 610 and a rear portion 630 behind the pivot 610 when the drawer 200 is mounted. An integral resilient arm 605 projects sideways out of the front portion 620 and abuts on the side surface of a downwardly extending wall 211 of the drawer main body 210. The resilient arm 605 biases the front portion 620 away from the guide block 500 and consequently biases the rear portion 630 towards the guide block 500. The rear portion 630 extends past the back end of the drawer 200 and includes a hook portion 635 at its distal end. When the drawer 200 is pulled out to the extent that all the stops 270 have passed the backward facing edge 3451 of the flap 345, the hook 635 engages with the back face of the guide block 500 (the face shown in FIG. 9B) to prevent the drawer 200 from being removed from the guide block 500. However, a user may use his finger to press the front portion 620 of the drawer release lever 600 against the biasing action of the resilient arm 605 to move hook 635 leftwards away from the cartridge 300 so that it no longer engages with the back face of the guide block 500. In this way, the drawer 200 can be fully removed from the cartridge 300.

Figure 15:
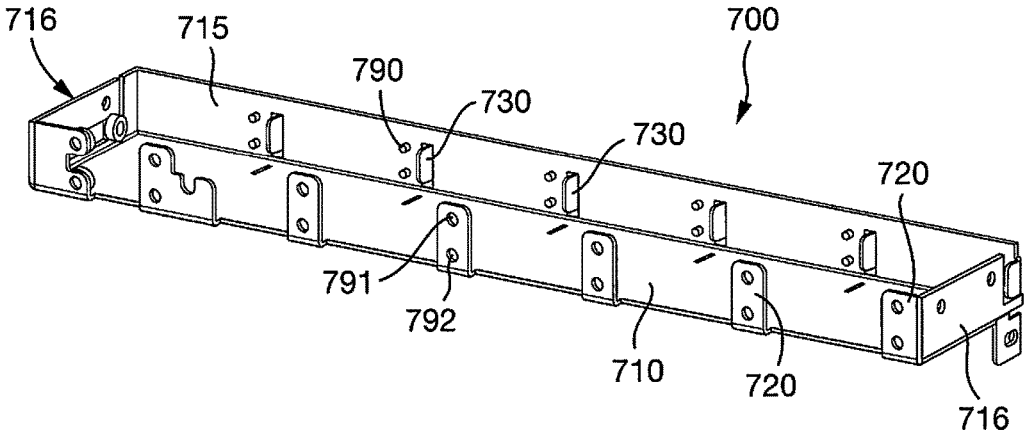
FIG. 15 is a perspective view of a cartridge mounting bracket shown in FIG. 1 according to an embodiment.

In use, a plurality of cartridges 300 are mounted to the cartridge mounting brackets 700, an example of which is shown in more detail in FIG. 15. The bracket 700 comprises a horizontal base plate 710 with an upright back wall 715 and upright side walls 716. Location members 730 project inwards from the back wall 715 at predetermined intervals. At corresponding intervals, fixing tabs 720 project upwards from the front edge of the base plate 710. Each of the fixing tabs 720 is provided with two holes 791, 792.

The cartridge mounting bracket 700 is fixed to the front two uprights 110 of the housing 100 frame at desired locations by the use of screws or bolts in the mounting holes provided in the respective side walls 716 and corresponding mounting holes provided in the uprights 110.

A cartridge 300 is mounted to the cartridge mounting bracket 700 by locating a fixing portion 390 at the bottom of its back surface (see FIG. 2) against a respective location member 730 and by fixing the two together using bolts or screws in the respective mounting holes 790 on the upright back wall 715 of the mounting bracket 700. In addition, a screw or a bolt is passed through the mounting hole 391 at the bottom front of the cartridge 300 and the upper mounting hole 791 of the corresponding fixing tab 720. The top of the cartridge 300 is fixed to an upper cartridge mounting bracket 700 by passing a screw or a bolt through the mounting hole 392 at the top front of the cartridge 300 and the lower mounting hole 792 of the corresponding fixing tab 720 of the upper bracket 700.

Figure 16:
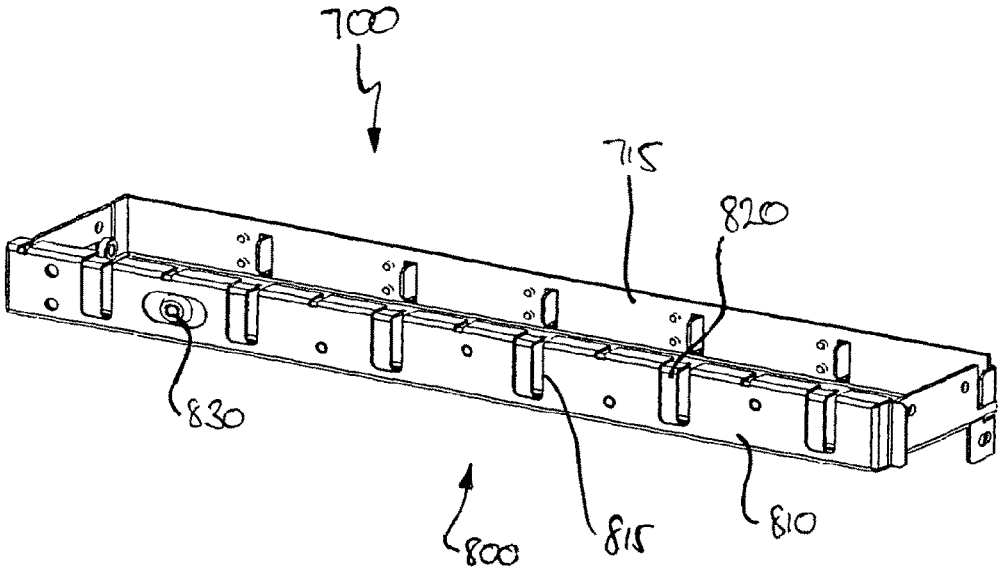
FIG. 16 is a perspective view of the cartridge mounting bracket shown in FIG. 15 with a locking cover plate fitted according to an embodiment.

As shown in FIG. 16 a lockable cover plate 800 is fitted to the front of the cartridge mounting bracket 700. The lockable cover plate 800 comprises a fixed plate 810 with a cut-out portion 815 provided for each cartridge 300, together with a sliding plate 820. The sliding plate 820 is mounted behind the fixed plate 810 and includes corresponding cut-out portions. The sliding plate 820 can be slid behind the fixed plate 810 so that the respective cut-out portions are co-located, thereby allowing access of a user's finger behind the cover plate 800, or so that the sliding plate 820 covers the cut-out portions 815 of the fixed plate 810, thereby preventing access behind the cover plate 800. The sliding plate 820 can be locked at least in a position that prevents access by means of the lock 830.

In the present embodiment, six mounting brackets 700 are provided in the housing, so that five rows of cartridges 300 can be fitted. Moreover, six cartridges 300 are mounted to the mounting brackets 700 in each row, and four drawers 200 are provided in each cartridge 300. A single cartridge and the drawers mounted to it may be termed a pod. Accordingly, up to 6×5=30 pods with a total of 30×4=120 drawers 200 can be provided in the housing. In the present embodiment, each drawer has 12 compartments. Thus, the machine 1 provides controlled access to 1440 separate items.

In practice, the apparatus is assembled by first assembling the individual cartridges 300 by fitting the circuit board 350, the latch mechanisms 347, the over-ride system 400 and the drawer guides 380 to the rear plate 311 of the cartridge 300 upright 310, and connecting the solenoids 340 to the circuit board 350 using the connectors 352. The guide blocks 500 are then mounted on to the rear plate 311 of the upright 310 as discussed above. After assembly of the cartridges 300 and fixing of the cartridge mounting brackets 700 to the frame, the cartridges 300 are fixed to cartridge mounting brackets 700. Alternatively, it is possible to make up an assembly of cartridge mounting brackets 700 and cartridges 300 and then fix one or more such assemblies to the frame. Once the cartridges 300 are mounted to the housing 100, they are electronically connected to the system circuit board 145 by means of I/O pins 357.

In addition, the drawers 200 are assembled by attaching the drawer handle 259, the index member 260 and the drawer release lever 600 to the drawer main body 210. The drawers 200 are slid into the correct positions in the cartridges 300 in the manner described above until they reach their home position so that the latch mechanism 347 prevents them from being opened. Assembly is then complete. The drawers can optionally be pre-stocked with articles before being slid into the correct positions, although this is certainly not essential.

Figure 19:
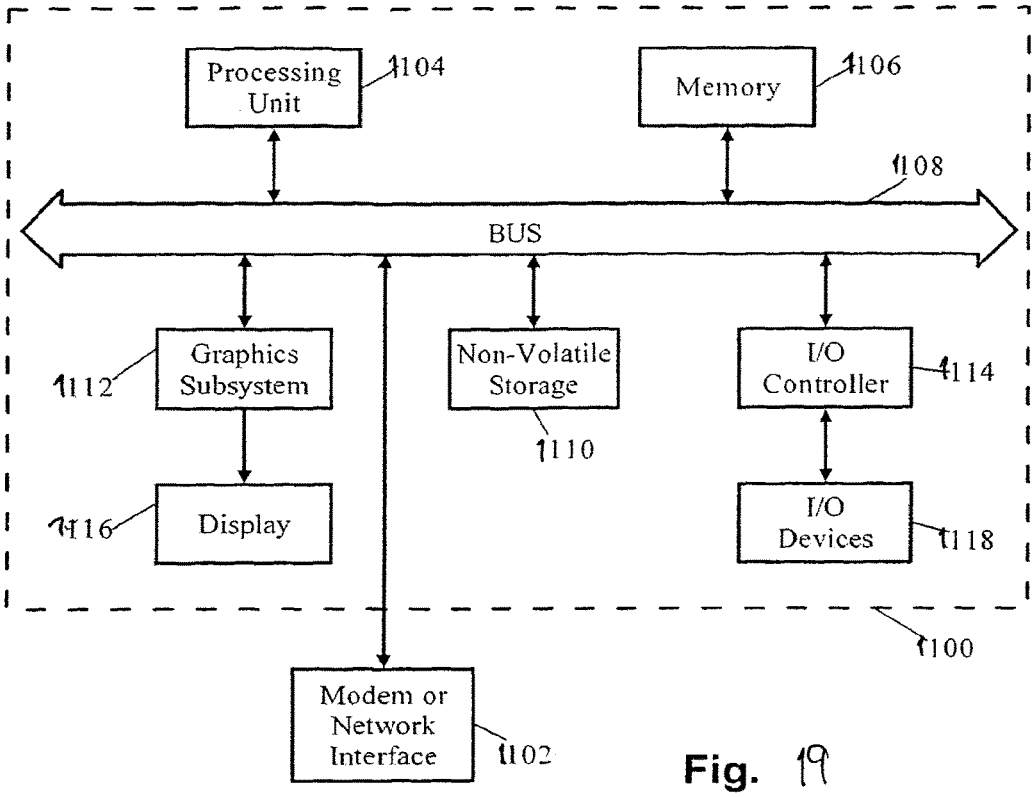
FIG. 19 illustrates an exemplary control system according to an embodiment.

FIG. 19 illustrates an exemplary embodiment of a computer system 1100 that may be used as the system control circuit 140 and system control circuit board 145. Computer system 1100 may form part of a desktop computer or a laptop computer, or any similar computer device, but is preferably permanently mounted to the housing 100.

The computer system 1100 can interface to external systems through a modem or network interface 1102, such as an analogue modem, ISDN modem, cable modem, token ring interface, or satellite transmission interface. As shown in FIG. 19, the computer system 140 includes a processing unit 1104, which can be a conventional microprocessor, such as an Intel Pentium microprocessor, an Intel Core Duo microprocessor, or a Motorola Power PC microprocessor, which are known to one of ordinary skill in the computer art. System memory 1106 is coupled to the processing unit 1104 by a system bus 1108. System memory 1106 may be a DRAM, RAM, static RAM (SRAM) or any combination thereof. Bus 1108 couples processing unit 1104 to system memory 1106, to non-volatile storage 1110, to graphics subsystem 1112 and to input/output (I/O) controller 1114. Graphics subsystem 1112 controls a display device 1116, such as a liquid crystal display, which may be part of the graphics subsystem 1112. The I/O devices 1118 may include one or more of a keyboard, disk drives, printers, a mouse, a touch screen and the like as known to one of ordinary skill in the computer art.

Where the described computer system 140 is employed as the system controller, control software will normally be stored on the non-volatile storage 1110. Thus, it may be stored on the machine's hard drive, or possibly on an externally connectable storage medium, such as a USB memory stick or a CD. These two devices would then constitute part of the I/O devices shown as item 1118 in FIG. 19. It should be noted that the non-volatile storage also stores a record of which are articles are stored in which drawers 200 (and optionally in which compartments 215 of which drawers 200), and, in an embodiment, which articles have been released, to whom and at what time.

The cartridge control circuit board 350 and cartridge control circuit 355 is similar in layout. However, the network interface is adapted to provide networking with the system control circuit 140. The I/O devices comprise the sensors 300 and the solenoids 340. The non-volatile storage of the cartridge control circuit 355 also stores software for calculating the position of the drawers 200 based on the sensors 330 and outputting solenoid activation/de-activation signals based on the results and input from the system control circuit 140.

The cartridge circuit board 350 has mounted thereon an LED indicator 360 for each drawer 200 as a further I/O device. Since the display comprises only indicator LEDs 360, the graphics subsystem shown in FIG. 19 is not required. The cartridge control circuit 355 causes the LED indicator 360 corresponding to the unlatched drawer 200 to emit light, which is visible to a user through a hole in the upright 310 and a corresponding hole in the drawer handle 350. In this way, the user is able to more easily see which drawer 200 s/he is able to open.

Although not shown, the modular supply system 1 further comprises a further user interface for control of access to the drawers 200. Exemplary user interfaces include display means and input means, such as a display screen, touch screen, push buttons, swipe card reader, keyboard, RFID reader and so forth, all of which may be I/O devices 1118 of the of the computer system 1100 (system circuit board 140 and system control circuit 145). The computer system 1100 is programmed with information concerning which articles are stored in which drawers 200 and, in an embodiment, which compartments 215 of which drawers 200, together with information concerning which users are allowed what access to the articles and, in some embodiments, with what degree of frequency. The system control circuit 140 allows predetermined users access to particular compartments 215 of drawers 200 based on this information.

Although not preferred, it is possible in embodiments for the non-volatile storage of the cartridge control circuit 355 to store some or all of the information described above concerning which are articles are stored in which drawers 200 (and optionally in which compartments 215 of which drawers 200), and, in an embodiment, which articles have been released, to whom and at what time, instead of or in addition to the system control circuit. Moreover, the stock information can be held by a drawer, for example in an RFID tag, so that when the drawer 200 is first inserted, if it contains pre-loaded stock, the stock contents can be automatically updated in the control software.

Typically, each compartment 215 in a single drawer 200 will contain the same articles and drawers 200 containing the same articles will be grouped together, although the skilled addressee will recognise that other arrangements are also possible.

For example, all the compartments 215 of a predetermined drawer 200 can contain a dose of medication in tablet form, and the other drawers 200 can contain different articles, such as different medications, syringes, bandages, surgical equipment and so forth. Access to the medication in the predetermined drawer 200 is restricted to doctors and senior nurses.

If a doctor requires a dose of the medication, he presents his RFID badge to the RFID reader of the system and uses an input mechanism (for example, touch screen menu system) to request access to the medication. The system control circuit 145 then causes the display device (I/O device 1118) to display to the doctor which drawer 200 the medication is stored in and causes the appropriate cartridge control circuit 355 to activate the appropriate solenoid 340 to unlatch the correct drawer 200 and to illuminate the appropriate LED 360. Once the drawer 200 has been drawn out a predetermined amount, the solenoid 340 is deactivated to cause the flap 345 to latch the stop 270 for the first compartment 215. Thus, the doctor can only pull out the drawer 200 far enough to expose the first compartment 215. He can then retrieve the tablets stored in the first compartment 215 by putting his finger in the finger-sized cut-out 255 and scooping the tablets out. The doctor then closes the drawer 200. The latch flap 345 will slide over the stops if the drawer 200 is pushed back in so there is no need to activate the solenoid. This has the further advantage that any person can push the drawer 200 back in if the doctor forgets. The system control circuitry 140 records that one dose of the medication has been released, and may record that the release was made to that particular doctor.

If a junior nurse then presents his RFID badge and requests access to the medication, the request is refused and the drawer 200 remains latched.

If a senior nurse then presents his RFID badge and requests access to the medication, the display device displays to the nurse which drawer 200 the medication is stored in and causes the appropriate cartridge control circuit 355 to activate the appropriate solenoid 340 to unlatch the correct drawer 200. Once the drawer 200 has been drawn out to the extent that the first cartridge 300 stop has passed the edge 3451 of the solenoid flap 345, the solenoid 340 is deactivated to cause the flap 345 to latch the stop 270 for the second compartment 215. Thus, the nurse can pull out the drawer 200 far enough to expose both the first and second compartments 215 and retrieve the tablets stored in the second compartment 215. The system control circuit 140 then records that another dose of the medication has been released, and can record that the release was made to that particular nurse.

Restocking of items within the drawer 200 can be implemented by either replacing the drawer 200 with an entirely new drawer 200, preloaded with stock (possibly with stock information exchanged to the machine via a non-contact read head mounted in the cartridge) or by the reverse of the dispense procedure. In this case, the machine allows an individual with sufficient access privileges to expose the rearmost compartment 215 in which no stock is contained, and thereby exposing all compartments 215 forward of the aforesaid compartment 215. The individual then loads stock into all the empty compartments 215. In an embodiment, stock is loaded into the drawer 200 from the back compartment 215 forwards with any empty compartments 215 located at the front of the drawer 200.

Those skilled in the art will recognise that embodiments of the modular supply system have a wide variety of different applications, from medical and manufacturing facilities of all different sizes to simple coin-operated vending machines.

A particularly advantageous feature of the system is the provision of a three point protection system that allows the drawers 200 to be securely fastened in the cartridges 300 but nonetheless allows individual drawers 200 to be easily removed from the front of the cartridge 300 without requiring special tools, without accessing the rear of the housing 100 and without affecting the control electronics of other drawers 200 or the cartridge 300. In particular, to remove a drawer 200 from the cartridge 300, a user provided with a suitable key unlocks the lock 830 on the cover plate 800 and moves the sliding plate 820 so that its cut-outs are aligned with those 815 of the fixed plate 810. This provides access for the user to insert his finger through the cut-out 815 and depress the finger bar 410 of the over-ride system 400, thereby lifting the over-ride bar 420 and unlatching all the latch mechanisms 347 mounted to the cartridge 300. This allows a selected drawer 200 to be pulled out along the guide block 500 without electronic control of the respective solenoid 340 until the hook 635 of the drawer release lever 600 abuts the guide block 500, which prevents the drawer 200 from being pulled out further.

It should be noted that the cartridge control circuit 355 is programmed never to allow unlatching past the stop 270 corresponding to the back-most compartment 215 in normal use, so that it is not possible to pull the drawer 200 out further than the last compartment 215 in normal use. The drawer 200 and the drawer release lever 600 are sized such that the front portion 620 cannot be reached by a user when the drawer 200 is pulled out to the last compartment 215 in normal use. However, when the over-ride system is operated to allow unlatching past the back compartment 215, the drawer 200 can be slid a predetermined distance forward until the hook 635 abuts the guide block 500. This predetermined distance is sufficient to bring the front portion 620 of the release lever 600 forward so that it can be reached by the user's finger. Thus, unlatching of the latch mechanism 347 using the over-ride system 400 allows the user to activate the release lever 600 and thereby fully remove the drawer 200 from the guide block 500.

Once all the intended drawers 200 have been removed from the guide blocks 500, the lockable cover plate can be re-locked, and newly-stocked drawers 200 can be simply slid into place. The newly-stocked drawers 200 can be the same as the drawers 200 that have just been removed or entirely new drawers 200 can be used in their place. This has the particular advantage that drawers 200 can be filled off-site and brought on-site for a particularly fast, trouble-free re-stocking operation, which is a very significant advantage over existing systems.

A further advantage is that the drawers 200 can be stocked off-site in a sterile environment and covered with a thin film wrap after stocking to maintain sterility and cleanliness of the drawers 200 and articles within the drawers 200. Where the guide notches are not provided in the compartment walls, it becomes particularly easy to maintain sterility in individual compartments 215, irrespective of whether articles have been removed from neighbouring compartments 215. Drawers 200 can also be easily removed for cleaning and/or sterilisation prior to re-use, and in the unlikely event of damage, drawers 200 can easily be replaced.

The use of cartridges 300 to mount drawers 200 in a stacked arrangement in this manner provides significant advantages in terms of modularity. For example, if it is desired to use drawers 200 of a different width in the modular storage system 1, all that is required is to space the cartridges 300 further apart and slide the drawers 200 of different widths into the cartridges 300. In particular, the system lends itself to the use of drawers 200 of different widths where the width of all the wider drawers 200 is an integral multiple of the width of the narrowest drawer 200. For example, FIG. 1 shows that in the lowest row the cartridges 300 are spaced to provide six cartridges 300 in the row, drawers 200 of the narrowest width being fitted in each cartridge 300. However, it would be possible to mount only two cartridges 300 in the row and use drawers 200 that are three times wider. Alternatively, a single cartridge 300 could be provided for use with a drawer 200 having six times the width, or the cartridges 300 could be spaced to provide: three drawers 200 having double the narrowest width; or one drawer 200 having three times the narrowest width, one drawer 200 having double the narrowest width and one drawer 200 having the narrowest width and so on. The skilled addressee will recognise that many permutations are possible.

In a similar fashion, the number of compartments 215 in each drawer 200 can be adjusted as desired, with the only further modification required being the positioning and number of stops on the side of the cartridge 300. Again, no modifications to the cartridge 300 are required.

Furthermore, the heights of the drawers 200 can also be modified without difficulty and without changing the guide blocks 500, preferably so that the height of each drawer 200 is an integral multiple of the height of the drawer 200 having the lowest profile. The cartridges 300 can then be assembled to provide only one guide block 500, latch mechanism 347, and drawer guide 380 for each drawer 200. In an embodiment, the drawer main body 210 of double- (or more-) height drawers 200 would be moulded so that when the drawer 200 is mounted to the guide block 500, the bottom of the guide block 500 continues to be substantially flush with the bottom of the drawer 200, such that the top of the drawer 200 extends above the top of the guide block 500. In this way simple moulding of the drawer main body 210 (which is discussed in more detail below) remains possible, without changing the shape of the guide blocks 500 or otherwise adjusting the configuration of the cartridges 300.

In practice, drawers of triple width and double height have been found to be particularly useful. In such cases, the additional support provided by drawer guide 380 and by the guidance notches 245 and the guidance rails 247 can be especially advantageous, especially if what is stored in a drawer is heavy. In this case, it is convenient but not essential to provide a support bar or plate (not shown) on which the guidance rail 247 of the bottom drawer 200 in a cartridge can run. Such a support bar or plate extends parallel to the guidance rail 247 from the cartridge mounting bracket at the front of the housing 100 to the rear of the housing 100. The support bar or plate can be supported at its rear end by a further strut (not shown) provided between the rear uprights and parallel to the lifting beams 130.

Of course, it would also be possible to redesign the drawers 200 so that the guide rail-engaging portions 210, 220 are disposed towards the top of the drawer 200, without changing the guide blocks 500. However, this would complicate design of the drawers 200 in that it would become difficult to mould them, thereby increasing their expense. In addition, the guide block 500 itself could be redesigned to accommodate taller drawers 200.

It can therefore be seen that embodiments allow a single storage system 1 to be very easily modified to provide a plurality of drawers 200 of different widths or heights or both. In the case of different width drawers 200, it is necessary only to remove some of the cartridges 300 from the frame. For different height drawers 200, it is necessary only to remove excess guide blocks 500 from the cartridge 300, unclip the solenoid 340 wiring leads of excess solenoids and remove the excess solenoids 500 from the cartridge 300. No other modifications are necessary. Consequently, embodiments provide a very significant improvement on the flexibility in design over existing storage systems.

The use of cartridges 300 to hold groups of drawers 200 in a stacked arrangement is also particularly advantageous. Specifically, the cartridges 300 assist in providing the modularity and flexibility of the present invention. The use of a single circuit board 350 for each cartridge 300 with a cartridge control circuit 355 allows distributed control of latching of the drawers 200 and significantly improves flexibility compared to the prior art.

Moreover, the use of the cartridges 300 to hold the drawers 200 in a stacked arrangement, with each drawer 200 being supported so that one side is adjacent the cartridge 300 represents a significant improvement. Specifically, this arrangement avoids the need to provide drawer runners extending from the front to the back of the housing 100 on both sides of every drawer 200. Rather the use of the guide blocks 500 to support the drawers 200 and guide them as they are opened and closed provides an exceptionally lightweight and compact means of containing the drawers 200 in the housing 1. This results in a very lightweight housing compared to the prior art, which is easy to install and comparatively easy to move once installed. Importantly, it results in a very much improved storage density in relation to comparable prior art storage systems whilst maintaining full control of access to individual compartments 215. Indeed, it has been found that storage density is improved by between 50% and 100%.

These advantages are further assisted by the drawers 200 sliding on lower drawers 200 when pulled out from the home position and the use of the drawer guide 380, the lifting tab 280 and lifting beam 130.

The use of the upper and lower rails 510, 520 on the guide block 500 has proved to be a very effective means to support and guide the drawers 200. Since the upper and lower rails 510, 520 extend in the depth direction of the housing, but only a short distance compared to the drawers 200, they act to provide effect support and guidance to the drawers 200, without significantly increasing the weight and volume of the cartridge 300. Example maximum dimensions of the drawers 200 are approximately 100 mm wide×80 mm high×400 mm deep and example maximum dimensions of the guide blocks 500 are 40 mm wide×80 mm high×120 mm deep. However, the ratio of the depth of the guide block 500 to the depth of the drawer 200 can be in the range 0.1 to 0.5, and is more specifically in the range 0.2 to 0.4 in embodiments. The arrangement in which, when the drawer 200 is mounted to the guide block 500, the sensors 330 and the index member 260 are disposed between the upper and lower rails is advantageous in providing consistently accurate determination of the position of the drawer 200.

More specifically, since the upper rail-engaging portion 220 of the drawer 200 is disposed adjacent to and between the upper rail 320 and the sensors 330, and the index member 260 is disposed adjacent to the sensors 330, accuracy of detection is improved.

In particular, the guide block 500 is mounted over the sensors 300, with the sensors 300 being positioned in the cavity 560 and the index member 260 being positioned to run through the notch 550, preferably very close to or abutting the downward-facing surface 555 of the front wall portion 556. This means that the index member 260 is consistently guided to be positioned directly adjacent the sensors 330 so that the position and movement of the drawer 200 can be detected with a high degree of accuracy. Importantly then, the guiding function of the guide block 500 ensures accurate control of latching.

In addition, since the lower rail 510 is disposed further from the cartridge upright 310 than the upper rail 220, and since the upwardly extending portion 514 of the lower rail runs in the groove 229 formed on the bottom wall of the drawer 200, the drawer 200 is particularly well supported and guided. This is because the guide block 500 supports and guides the drawer 200 both at its side surface and its bottom surface. Moreover, this positioning of the lower rail 520 and the groove 229 effectively counters the moment caused by the weight of the drawer 200 about the upper guide rail, so that the drawer 200 can be smoothly and easily pulled out from the home position without skewing.

In short, the upper rail 520 advantageously positions the index member 260 close to the sensors 330 and the lower rail 510 advantageously supports the bottom of the drawer 200, and together they hold the drawer 200 so that its side is adjacent the cartridge 300, with consequent advantages in modularity, and guide it during movement for smooth, easy and accurate use.

A further advantage of the specific arrangement of the various features of the drawer main body 210 is that the drawer main body 210 can be easily formed by using an injection moulding process without side action. Specifically, the provision of the downward-facing groove 229 on the bottom wall and the upward-facing U-shape of the upper rail-engaging portion 220 on the side wall means that there are no undercuts in the design, so that the drawer main body 210 can be injection-moulded as one piece without the use of side action. It should be noted that the provision of the compartments 215, compartment walls 240, side wall cut-outs 255, guidance protrusion 247, compartment stops 270, downward-facing surface 290, curved inner compartment side walls 256, guidance notch 245, lifting tab 280 and index member fixing portion are all designed so that one-piece moulding without side action is possible. Accordingly, despite the relative complexity and high degree of functionality of the drawer main body 210, it can be manufactured cheaply and accurately with low tooling set-up and maintenance costs. This provides a significant competitive advantage.

In the foregoing, it was mentioned that in use the display means indicates which drawer 200 the user is allowed to access. In practice, the display means is the LED 360 provided for each drawer 200 on the cartridge 300. However, the display means can also or instead comprise an LCD monitor on which is displayed an image of the housing 1 with the correct drawer 200 highlighted.

Alternatively or in addition, a spring can be provided on the housing back plate (not shown) in correspondence to each drawer 200. The spring can act on the back face of the drawer 200 to bias it against the latching action of the solenoid flap 345, so that when the latch is released the drawer 200 automatically moves out from the home position at least a short distance. In this way, the user can immediately see which drawer 200 has been unlatched.

The foregoing description has been given by way of example only and it will be appreciated by a person skilled in the art that modifications can be made without departing from the scope of the invention.

In particular, the number of compartments 215 in each drawer 200, the number of drawers 200, the number of rows of drawers 200, the number of cartridges 300, the number of drawers 200 per cartridge 300 and the relative dimensions of the cartridges 300, the drawers 200 and the housing 100 are not limited. Indeed, a particular advantage of embodiments is the high degree of modularity and adaptability it affords.

In the foregoing description, the drawers 200 are supported by the cartridge 300 in combination with the drawer guide 380 and the lifting beam 130. However neither the drawer guide nor the lifting beam 130, nor the corresponding features of the drawer 200 are essential features of the invention. Similarly, it is possible for the guide block 500 to fully support the drawers 200 without them contacting one another when they are pulled out from the home position. The use of the guidance rail 247 and the guidance notch 245 are likewise optional, as are the cut-outs 255 and the curved internal compartment walls 256.

The latching mechanism 247 described above uses a solenoid 340 and a solenoid flap 345. However, the person skilled in the art will recognise that many other latching mechanisms could be used, whether with or without a solenoid. Where a solenoid 340 is used, the particular arrangement described is not necessary. For example, there is no need to provide the solenoid tab 3400 and the spring 348 can be attached to the upright 310 directly or to the guide block 500.

The arrangement described above for detecting the drawers 200 comprises three sensors, each comprising an LED emitter and a light receiver, acting in concert with a metal bar provided with holes acting as a raster strip. However, other arrangements are envisioned, including the use of different numbers and types of sensors. For example, the sensors could comprise light emitting means and receivers adapted to detect light reflected from a raster strip on the drawers 200. Alternatively, mechanical/electrical switch means opened or closed as the drawers 200 slide past, or RFID sensing means, could be used. The raster strip need not be metal and need not have holes in. Any suitable index member could be used. Moreover, the sensors could be disposed on the drawer 200 and the index member on the guide block 500.

The sensing arrangement has been described as detecting the home position of the drawer 200 directly, as well the speed and the direction of movement of the drawer 200 based on the speed and pattern of detection signals output by the light receivers 334, 335, 336. In this way, the position of the drawers 200 can be detected. However, other arrangements are also possible. For example, the sensing arrangement can be able to directly detect a position of each compartment 215 in the same way as the home position, or by detecting the number of times the or each light receiver is activated. It will be clear that different numbers of sensors and different layouts of index members can become appropriate depending on the precise implementation.

The circuitry described above includes a system control circuit 140 acting in concert with a plurality of cartridge control circuits 355. The processing functions carried between these controllers can be distributed in any way to provide the appropriate functionality. In addition, it is not necessary to provide a separate control circuit for each cartridge 300—rather, all process control could be carried out by the centralized system controller. Conversely, a separate control circuit could be provided for each drawer 200.

The precise arrangements of the upper and lower rails and the upper and lower rail-engagement portions can also be varied. For example, both the upper and lower rail-engagement portions can be provided on the side of the drawer 200. Also the upper and lower rail-engagement portions can be provided on the guide block 500 and the upper and lower rails can be provided on the drawers 200. Different numbers of these parts can also be provided. Similarly, the positional relationship between the sensors, rails, rail-engagement portions and index members can also be varied.

It is further noted that the guidance notches 245 on the top of the compartment wall 240 and the guidance rail 247 on the bottom are not essential features of embodiments. Moreover, their respective positions in the width direction can be varied. The notches 245 may be provided on the bottom of the drawer 200 and the guidance rail 247 on the top.

The foregoing description of illustrated embodiments of the present invention, including what is described in the abstract, is not intended to be exhaustive or to limit the invention to the precise forms disclosed herein. While specific embodiments of the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

The invention claimed is:

1. A drawer comprising:

at least one compartment open at the top of the drawer;

an upper rail-engaging portion for engaging an upper rail of a holding apparatus, the upper rail-engaging portion comprising a first groove facing in a first direction for engaging a projection of the upper rail, the upper rail-engaging portion being provided on a first side of the drawer, the upper rail-engaging portion further comprising a first portion extending away from the first side and a second portion extending orthogonally to the first portion;

a lower rail-engaging portion for engaging a lower rail of the holding apparatus, the lower rail-engaging portion comprising a second groove facing opposite the first direction for engaging a projection of the lower rail, the lower rail-engaging portion is formed at a corner of the drawer between the first side and a bottom portion of the drawer, the lower rail-engaging portion being misaligned with respect to the upper rail-engaging portion;

the upper and lower rail-engaging portions extending substantially for a depth of the drawer for mounting the first side of the drawer adjacent the holding apparatus such that the drawer is able to slide along the upper and lower rails of the holding apparatus from a home position to an extended position in which the drawer is pulled out, wherein corresponding upper and lower rail-engaging portions for mounting an opposite, second side of the drawer are absent; and a drawer information member disposed between the upper and lower rail-engaging portions, the drawer information member being disposed adjacent the upper rail-engaging portion.

2. A drawer according to claim 1, further comprising a drawer release lever disposed at the back of drawer, the release lever being biased for latching the drawer to the holding apparatus.

3. A drawer according to claim 1, further comprising a lifting portion adapted to engage with lifting member provided by the holding apparatus to lift a back portion of the drawer.

4. A drawer according to claim 1, further comprising:

a guide notch or a guide protrusion extending longitudinally along the top of the drawer and disposed towards a second side opposite the first side; and a guide protrusion or a guide notch extending longitudinally along bottom of drawer under the guide protrusion, whereby the guide protrusion or guide notch of an upper drawer is adapted to engage with the guide notch or guide protrusion of a lower drawer.

5. A drawer according to claim 4, wherein the drawer has a plurality of compartments separated by respective compartment walls, the guide notch or guide protrusion extending longitudinally along the top of the drawer being formed in or on the top of compartment walls.

6. A cartridge for holding a plurality of drawers above one another, said cartridge comprising:

a plurality of drawers according to claim 1;

an upright; and, provided on one side of the upright for each one of the plurality of drawers:

a guide block for mounting the drawer to one side of the cartridge;

a sensor for providing information on at least one of position and movement of the drawer based on the drawer information member; and a latch mechanism, which is electronically controllable, for engaging with the drawer, whereby access to each drawer can be controlled.

7. A cartridge according to claim 6, adapted to control opening and closing of said latch mechanism based on information from a respective cartridge information device.

8. A cartridge according to claim 6, further comprising an over-ride system, by means of which each latch mechanism can be manually opened together.

9. A cartridge according to claim 8, wherein the over-ride system comprises:

a finger bar; and an over-ride bar pivotally connected to the finger bar, whereby movement of the finger bar moves the over-ride bar to open each latch mechanism.

10. A cartridge according to claim 8, wherein a drawer guide is mounted on the side of the upright opposite to the side on which the guide block, drawer information device and latch mechanism are mounted.

11. A storage system comprising:

a cartridge, said cartridge including an upright having mounted on one side a plurality of guide blocks each having an upper rail and a lower rail on one side;

a plurality of cartridge information devices; and a plurality of latch mechanisms, said system further comprising a plurality of drawers according to claim 1, each said drawer including the upper and lower rail engaging portions engaging with the upper and lower rails of a respective guide block for mounting a first side of the drawer adjacent the respective guide block;

the drawer information member disposed adjacent the cartridge information device, said drawer information member and cartridge information device for providing information on at least one of position and movement of said drawer; and at least one stop on the first side of the drawer for engaging with a said latch mechanism, wherein the latch mechanisms are electronically controllable for regulating access to the drawers.

12. A storage system according to claim 11, further comprising a lockable cover plate for preventing access to an over-ride system.

13. A storage system according to claim 11, wherein a width of a drawer mounted to a first cartridge is different from a width of a drawer mounted to a second cartridge.

14. A storage system according to claim 13, wherein the width of a first drawer is substantially an integral multiple of a width of a second drawer.

15. A storage system according to claim 11, wherein a first drawer mounted to a first cartridge has a different height to a second drawer mounted to the first cartridge.

* * * * *